US007399564B2

(12) United States Patent
Azuma et al.

(10) Patent No.: US 7,399,564 B2
(45) Date of Patent: Jul. 15, 2008

(54) ELECTROPHOTOGRAPHIC PHOTOCONDUCTOR

(75) Inventors: Jun Azuma, Osaka (JP); Junichiro Otsubo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/511,953

(22) Filed: Aug. 29, 2006

(65) Prior Publication Data

US 2007/0054209 A1 Mar. 8, 2007

(30) Foreign Application Priority Data

Sep. 7, 2005 (JP) ..... 2005-259029

(51) Int. Cl.
*G03G 15/02* (2006.01)

(52) U.S. Cl. ..... 430/59.6; 430/70; 430/59.5

(58) Field of Classification Search ..... 430/70, 430/59.5, 59.6

See application file for complete search history.

(56) References Cited

U.S. PATENT DOCUMENTS 6,485,873 B1 * 11/2002 Ohkura et al. ..... 430/83

FOREIGN PATENT DOCUMENTS

JP 06-075394 3/1994
JP 2000-314969 11/2000
JP 2001-242656 9/2001

OTHER PUBLICATIONS

Diamond, Handbook of Imaging Materials, Marcel Dekker, NY, NY, 1991. pp. 398-399.*

* cited by examiner

*Primary Examiner*—Mark F. Huff
*Assistant Examiner*—Peter L Vajda
(74) *Attorney, Agent, or Firm*—Carmody & Torrance LLP

(57) ABSTRACT

An electrophotographic photoconductor where generation of cracks, crystallization of a photosensitive layer, and the like occur infrequently by sticking of finger oil. An electrophotographic photoconductor includes a conductive substrate on which a photosensitive layer containing at least a charge generating agent, a hole transfer agent and a binding resin is provided, wherein the binding resin is comprised of a plurality of polycarbonate resins; and the photosensitive layer contains a biphenyl derivative as a plasticizer component represented by the following general formula (1).

(1)

(wherein $R^1$ to $R^{10}$ each independently represent a substituted or unsubstituted alkyl group having 1 to 12 carbon atoms, and R represents a substituted or unsubstituted aryl group having 1 to 12 carbon atoms or a substituted or unsubstituted alkylene group having 1 to 12 carbon atoms).

9 Claims, 11 Drawing Sheets

ELECTROPHOTOGRAPHIC PHOTOCONDUCTOR

BACKGROUND OF THE INVENTION

1. Field of the Invention

The present invention relates to an electrophotographic photoconductor, and more particularly to an electrophotographic photoconductor where there are little generation of cracks, crystallization of a photosensitive layer, and the like due to the sticking of finger oil or the like.

2. Related Art

Conventionally, as an electrophotographic photoconductor to be used in an image-forming apparatus, an organic photoconductor has been widely used. The organic photoconductor is comprised of a charge generating agent for generating electric charges by light irradiation, a charge transfer agent for transporting charges generated by the charge generating agent, a binding resin that constitutes a layer on which these substances are being dispersed, and so on.

In addition, an image-forming process is carried out on such an organic photoconductor. The process includes the steps of charging the surface of the organic photoconductor (main charging step), forming an electrostatic latent image (exposure step), developing the electrostatic latent image by toner while being applied with a development bias current, transferring a toner image formed from the organic photoconductor to a sheet of transfer paper by a reversal development system (transfer step), and fixing the toner image thereon by heat to form a predetermined image.

Furthermore, the residual toner on the organic photoconductor is removed by a cleaning blade (cleaning step), while the residual charges on the organic photoconductor are eliminated by LED or the like (neutralization step).

However, the conventional electrophotographic photoconductor has problems, such as less endurance as well as low sensitivity.

To solve the problems, a positively-charged monolayer-type electrophotographic photoconductor has been disclosed such that an electrophotographic photoconductor to be employed in a reversal development system uses a certain electron transfer agent together with the addition of a tarphenyl compound to improve gas resistance while reducing the size of a transfer image memory (for example, Patent document 1).

In addition, for improving the positive-charging and repeating properties, a monolayer-type electrophotographic photoconductor containing a certain charge generating agent, a chare transfer agent, and a binding resin has been disclosed such that it is further added with a biphenyl derivative (for example, Patent document 2).

Furthermore, an electrophotographic photoconductor has been disclosed such that a certain stilbene derivative and a polycarbonate resin are used as a hole transfer agent, and a biphenyl derivative and a sebacic acid derivative are also added (For example, Patent document 3).

Patent document 1: JP 2001-242656 A (Claims)

Patent document 2: JP 2000-314969 A (Claims)

Patent document 3: JP Hei6-75394 A (Claims)

SUMMARY OF THE INVENTION

Problems to be Solved

However, the electrophotographic photoconductors disclosed in the above patent documents still have problems, such as less endurance and less abrasion resistance, as well as insufficient sensitive properties.

In addition, the electrophotographic photoconductors disclosed in the above patent documents have additional problems, such as increased tendencies of generation of cracks and crystallization of photosensitive layers due to the sticking of finger oil or the like.

Therefore, as a result of extensive investigation, the present inventors have found out that the use of a plurality of polycarbonate resins together with the addition of a given plasticizer component together can effectively prevent the generation of cracks and crystallization due to the sticking of finger oil or the like by maintaining the good endurance and abrasion resistance as well as the good sensitive property.

In other words, the present invention intends to provide an electrophotographic photoconductor showing a reduced occurrence of cracks and crystallization of a photosensitive layer due to the sticking of finger oil or the like by maintaining a good endurance and abrasion resistance as well as good sensitive property.

The Means for Solving the Problems

According to the electrophotographic photoconductor of the present invention, the above problems can be dissolved by providing an electrophotographic photoconductor characterized in that the electrophotographic photoconductor having a conductive substrate on which a photosensitive layer containing at least a charge generating agent, a hole transfer agent and a binding resin is provided, wherein the binding resin is comprised of a plurality of polycarbonate resins, and also the photosensitive layer contains a biphenyl derivative as a plasticizer component, represented by the general formula (1) below.

In other words, such a configuration of the electrophotographic photoconductor allows a plurality of polycarbonate resins provided as a binder rein and the plasticizer component having a certain structure to exert their interaction with each other. Consequently, it improves the endurance and abrasion resistance of the photoconductor as well as the sensitive property thereof, while effectively preventing the generation of cracks and crystallization due to the sticking of finger oil or the like.

(1)

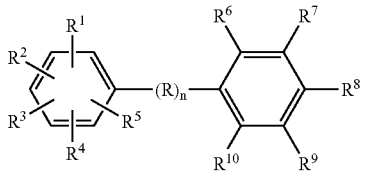

(In the general formula (1),wherein $R^1$ to $R^{10}$ each independently represent a hydrogen atom, a halogen atom, a substituted or unsubstituted alkyl group having 1 to 12, a substituted or unsubstituted alkoxyl group having 1 to 12, a substituted or unsubstituted aryl group having 6 to 30, a substituted or unsubstituted aralkyl group having 6 to 30, a hydroxyl group, a cyano group, a nitro group, an amino group, and "R" represents a substituted or unsubstituted alkylene group having 1 to 12 or organic functional group containing nitrogen atom, and the number of repetitions "n" is an integer of 0 to 3).

For configuring the electrophotographic photoconductor, preferably, when the photosensitive layer is of a monolayer-type, it is favorable that the amount of the plasticizer component added may be in the range of 0.1 to 15 parts by weight with respect to 100 parts by weight of the binding resin.

Such a configuration of the electrophotographic photoconductor allows, even if the photosensitive layer is of a monolayer-type including a charge generating agent and a hole transfer agent, the binding resin and the plasticizer component to exert their interaction with each other. Consequently, it could prevent the generation of cracks and crystallization due to the sticking of finger oil or the like by maintaining the good endurance and abrasion resistance as well as the good sensitive property.

For configuring the electrophotographic photoconductor, preferably, when the photosensitive layer is of a multilayer-type, it is favorable that the amount of the plasticizer component added may be in the range of 1 to 30 parts by weight with respect to 100 parts by weight of the binding resin in a surface layer of the multilayer-type photosensitive layer.

Such a configuration of the electrophotographic photoconductor allows, even if the photosensitive layer is of a monolayer-type, the binding resin and the plasticizer component to exert their interaction with each other. Consequently, it could prevent the generation of cracks and crystallization due to the sticking of finger oil or the like by maintaining the good endurance and abrasion resistance as well as the good sensitive property.

Furthermore, for configuring the electrophotographic photoconductor, preferably, it is favorable that the plasticizer component may be a compound represented by one of the formulae (2) to (6) below or a derivative thereof.

Such a configuration of the electrophotographic photoconductor allows the binding resin and the plasticizer component to exert their interaction with each other. Consequently, it could prevent the generation of cracks and crystallization due to the sticking of finger oil or the like by maintaining the good endurance and abrasion resistance as well as the good sensitive property.

(2)

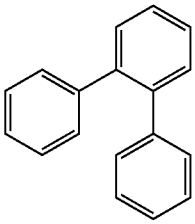

(BP-1)

(3)

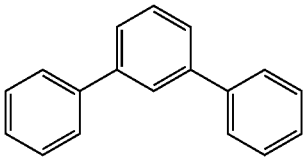

(BP-2)

-continued (4)

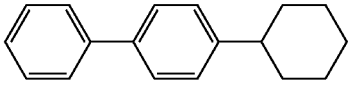

(BP-3)

(5)

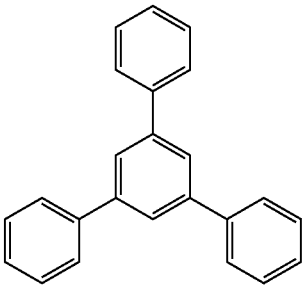

(BP-4)

(6)

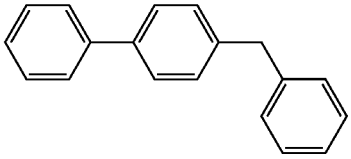

(BP-5)

Furthermore, for configuring the electrophotographic photoconductor, it is favorable that the plurality of polycarbonate resins may contain a polycarbonate resin represented by the general formula (7) below and a polycarbonate resin represented by the general formula (8) or (9) below.

Such a configuration of the electrophotographic photoconductor allows the plasticizer component to be selectively blended with a polycarbonate resin having a molecular structure represented by the general formula (8) or (9) in a compatible manner and to obtain a mechanical strength by a polycarbonate resin represented by the general formula (7). Consequently, it becomes possible to simultaneously obtain opposite properties, finger-oil resistance and abrasion resistance.

(7)

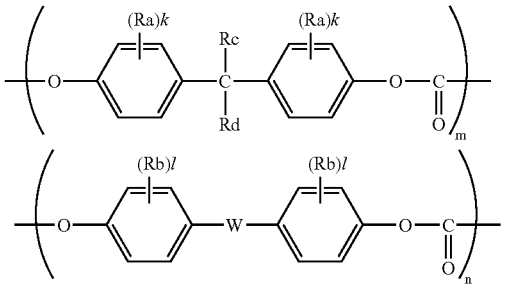

(In the general formula (7), Ra and Rb each independently represent a hydrogen atom, an alkyl group having 1 to 4 carbon atoms, or a substituted or unsubstituted aryl group having 6 to 12 carbon atoms, where the subscripts "k" and "l" each independently represent an integer of 0 to 4; Rc and Rd each represent an alkyl group having 1 to 2 carbon atoms, W represents a single bond or —O— or —CO— and the subscripts "m" and "n" each represent a mole ratio that satisfies a relational expression of $0.05<n/(n+m)<0.6$).

(8)

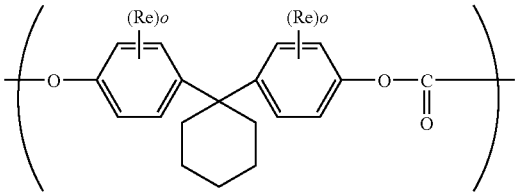

(In the general formula (8), each of plural substituents Re represents a hydrogen atom, a substituted or unsubstituted alkyl group having 1 to 4 carbon atoms, or a substituted or unsubstituted aryl group having 6 to 30 carbon atoms, and the subscript "o" represents an integer of 0 to 4)

(9)

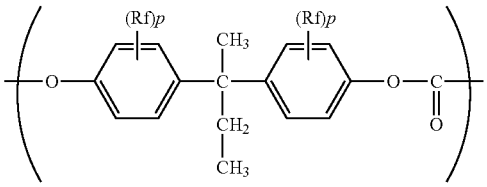

(In the general formula (9), each of plural substituents Rf represents a hydrogen atom, a substituted or unsubstituted alkyl group having 1 to 4 carbon atoms, or a substituted or unsubstituted aryl group having 6 to 30 carbon atoms, and the subscript "p" represents an integer of 0 to 4).

For configuring the electrophotographic photoconductor of the present invention, it is favorable that the charge generating agent is a titanyl phthalocyanine crystal having the maximum peak at a Bragg angle of $2\theta \pm 0.2° = 27.2°$ in the CuK$\alpha$ characteristic X-ray diffraction spectrum and having one peak generated at a temperature within the range of 270 to 400° C. in addition to another peak due to vaporization of absorbed water in a differential scanning calorimeter(DSC).

Such a configuration of the electrophotographic photoconductor allows the coating solution for a photosensitive layer to show an excellent storage stability which is depending on the fact that such given titanyl phthalocyanine crystal, has an excellent charge generating ability as well as an excellent stability in an organic solvent. Therefore, for example, even in the case of using a coating solution for a photosensitive layer after seven or more days from the production thereof, an electrophotographic photoconductor having an excellent sensitive property can be produced more stably.

Furthermore, since the given titanyl phthalocyanine crystal shows an excellent dispersibility in the coating solution for a photosensitive layer, the generation of fogging can be effectively inhibited even when a large amount of an additive is used.

For configuring the electrophotographic photoconductor of the present invention, it is favorable that the photosensitive layer may have a 95% response time (a time period required for attaining an electrostatic voltage of 130 V at a light exposure of 780 nm in wavelength, which corresponds to an electrostatic voltage of 100 V reached after 300 msec from electrification under the conditions of 700 V at 23° C.) of 20 msec or less.

Such a configuration of the electrophotographic photoconductor allows the photoconductor to stably obtain a given sensitive property.

Furthermore, for configuring the electrophotographic photoconductor of the present invention, it is favorable that the photosensitive layer may have a glass transition point (DSC measurement) of 65° C. or more.

Such a configuration of the electrophotographic photoconductor allows the photoconductor to obtain stably improved abrasion resistance and sensitive properties while effectively preventing a given sensitive property due to the sticking of finger oil or the like.

Furthermore, for configuring the electrophotographic photoconductor of the present invention, it is favorable that the hole transfer agent may be a bisstilbene compound or a bisbutadiene compound.

Such a configuration of the electrophotographic photoconductor allows the photoconductor to obtain stably improved abrasion resistance and sensitive properties while effectively preventing a given sensitive property due to the sticking of finger oil or the like.

Furthermore, for configuring the electrophotographic photoconductor of the present invention, it is favorable that the bisstilbene compound or the bisbutadiene compound may have a symmetrical structure.

Such a configuration of the electrophotographic photoconductor allows the plasticizer component to be selectively blended with a polycarbonate resin having a certain molecular structure in a compatible manner and the photoconductor to obtain stably improved abrasion resistance and sensitive properties while effectively preventing a given sensitive property due to the sticking of finger oil or the like.

Here, the phrase "the bisstilbene compound or the bisbutadiene compound may have a symmetrical structure" means that, as is the case for any of the compounds represented by the formulae (14) to (17), when the compound is divided along a reference carbon or a reference plane, opposite sides thereof are mirror-symmetrical.

DETAILED DESCRIPTION OF THE INVENTION

First Embodiment

Figure 1:
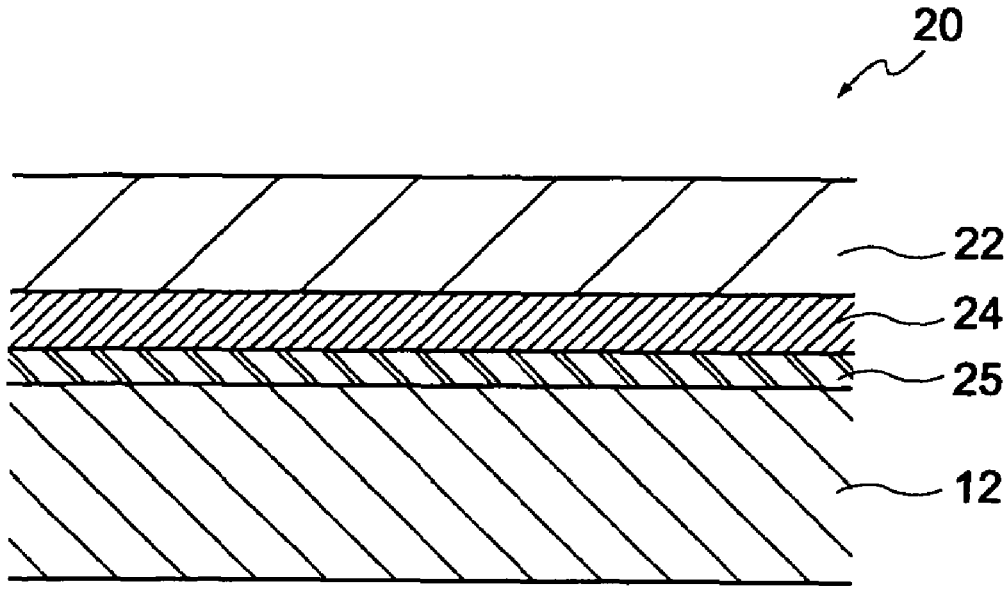
FIG. 1 is a schematic diagram for illustrating the configuration of a multilayer-type electrophotographic photoconductor.

As exemplified in FIG. 1, a first embodiment of the present invention is an electrophotographic photoconductor having a conductive substrate on which a photosensitive layer containing at least a charge generating agent, a hole transfer agent and a binding resin is provided. The electrophotographic photoconductor is characterized in that the binding resin is comprised of a plurality of polycarbonate resins and the photosensitive layer contains a biphenyl derivative as a plasticizer component.

Hereinafter, the multilayer-type electrophotographic photoconductor in accordance with the first embodiment of the present invention will be concretely described.

1. Supporting Substrate

As a supporting substrate 12 as exemplified in FIG. 1, any of various materials having conductivities can be used. For instance, the materials include metals such as iron, aluminum, cupper, tin, platinum, vanadium, molybdenum, chrome, cadmium, titanium, nickel, palladium, indium, stainless steel, and brass; plastic materials on which the above materials are deposited or laminated; and glass materials covered with aluminum iodide, tin oxide, and indium oxide.

In addition, the supporting substrate may be in the shape of a sheet, a drum, or the like depending on the configuration of an image-forming apparatus to be used as far as he substrate itself or the surface thereof has conductivity. In addition, preferably, the supporting substrate may have a sufficient mechanical strength in use.

Furthermore, for preventing the generation of interference fringes, it is preferable to carry out a surface-roughening process on the surface of the supporting substance using any of methods including etching, anodizing, wet-blasting, sandblasting, rough-cutting, and centerless-cutting.

By the way, when the anodizing process or the like is carried out on the supporting substance, it might become one having nonconductive or semiconductive property. Even in such a case, as far as the supporting substance shows a given effect, it may be contained in the conductive substrate.

2. Intermediate Layer (1) Basic Configuration

As exemplified in FIG. 1, an intermediate layer 25 containing a given binding resin may be provided on the supporting substrate 12.

(2) Binding Resin

The binding resins, which can be used in the intermediate layer, include thermoplastic resins such as polyvinyl alcohol, polyvinyl butyral, casein, sodium polyacrylate, copolymerized nylon, and methoxymethylated nylon; and thermosetting resins such as polyurethane, melamine, epoxy, alkyd, phenolic, acrylic, and fluorine resins.

(3) Additives

Furthermore, within the limits of sedimentation or the like during the production, for preventing the generation of interference fringes by causing light scattering, and attempting an improvement in dispersibility, a small amount of any of various additives (organic fine powders or inorganic fine powders) may be preferably added.

In particular, the additives include inorganic pigments, for example, while pigments such as titanium oxide, zinc oxide, zinc sulfide, white lead, and lithopone and loading pigments such as alumina, calcium carbonate, and barium sulfate; fluorocarbon resin particles; benzoguanamine resin particles; and styrene resin particles.

In addition, when the additives such as fine powders are added, the particle sizes thereof may be preferably in the range of 0.01 to 3 μm. This is because, when the particle sizes are too large, for example, the irregularity of the intermediate layer may become too large, an electrically uneven portion may occur, or an image defect may tend to occur. In contrast, when the particle sizes are too small, a light-scattering effect may not be sufficiently obtained.

Furthermore, when the additives such as fine particles are added, the amounts of the additives added may be preferably in the range of 20 to 500 parts by weight, more preferably in the range of 50 to 300 parts by weight with respect to 100 parts by weight of the resin of the intermediate layer.

(4) Film Thickness

In addition, by thickening the film thickness of the intermediate layer, an increase in cover-up of the irregularity of the support substrate may occur. Thus, the number of image defects in the form of a spot may preferably tend to be reduced. In contrast, the electric characteristics, such as an increase in residual potential, may tend to be decreased.

Therefore, it is preferable that the intermediate layer may have a film thickness of 0.1 to 50 μm.

3. Charge Generating Layer (1) Basic Configuration

A charge generating layer is constructed of a material coated with a coating solution for a charge generating layer, which contains 20 to 500 parts by weight of a charge generating substance and 1,000 to 50,000 parts by weight of an organic solvent with respect to 100 parts by weight of the binding resin. In other words, the charge generating layer can be prepared by the application of a given coating liquid for a generating layer, followed by dispersing an organic solvent therein.

This is because the charge generating layer is constructed from the coating solution for the charge generating layer having such a blending ratio and thus a more uniform, stable charge generating layer can be prepared.

Therefore, a blight potential under the conditions of low temperature and low humidity and a fogging property under the high temperature and high humidity can enhance, thereby allowing the photoconductor to be stably and economically formed.

By the way, the charge generation may have a film thickness of 0.01 to 5.0 μm, preferably 0.05 to 3.0 μm.

(2) Charge Generating Agent

Charge generating agents to be used in the electrophotographic photoconductor of the present invention include: organic photoconductors, for example phthalocyanine pigments such as metal-free phthalocyanine and oxotitanyl phthalocyanine pigments, perylene pigments, bisazo pigments, dithioketo pyrroropyrrole pigments, metal-free naphthalocyanine pigments, squaraine pigments, triazo pigments, indigo pigments, azulenium pigments, cyanine pigments, pyrylium pigments, anthanthrone pigments, triphenylmethane pigments, threne pigments, toluidine pigments, pyrazoline pigments, and quinacridon pigments; and inorganic photoconductors, for example selenium, selenium-tellurium, selenium-arsenic, cadmium sulfide, and amorphous silicon, which are conventionally known.

Among these charge generating agents, specifically, it is more preferable to use any of the phthalocyanine pigments (CGM-A to CGM-D) represented by the following formulae (10) to (13).

(10)

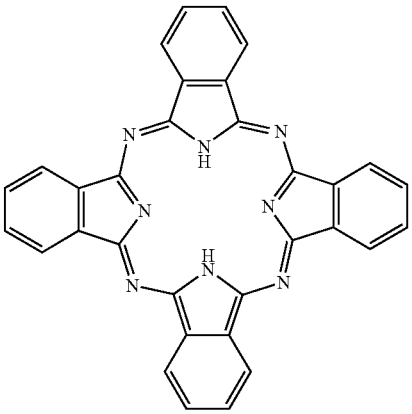

(CGM-A)

(11)

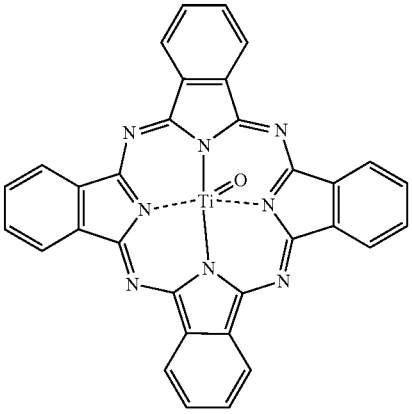

(CGM-B)

(12)

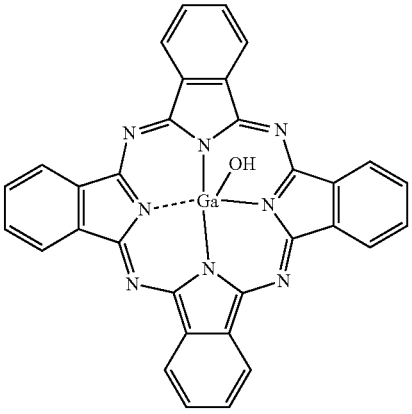

(CGM-C)

-continued (13)

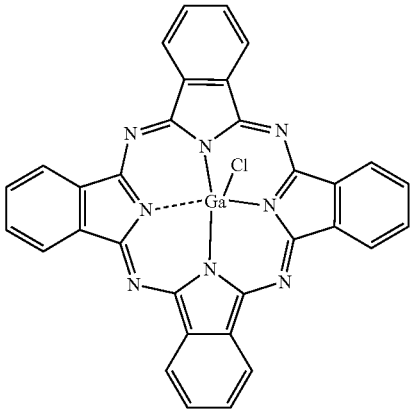

(CGM-D)

Furthermore, in particular, when a photoconductor is used in an image-forming apparatus with a digital optical system, such as a laser-beam printer or a facsimile apparatus, in which a semiconductor laser or the like is employed as an optical source, it should be of having sensitivities at wavelengths of 600 to 800 nm or more. Thus, preferably, the photoconductor may contain at least one of metal-free naphthalocyanine, hydroxygallium phthalocyanine, and chlorogallium phthalocyanine among the charge generating agents described above.

On the other hand, when a photoconductor is used in an image-forming apparatus with an analog optical system, such as an electrostatic copying machine, equipped with a halogen lamp or the like as a white light source, it should be of having sensitivities in the visible region. Thus, for example, a perylene pigment or a bisazo pigment may be preferably employed.

Furthermore, in the case of a monolayer-type photoconductor, the amount of the charge generating agent added may be preferably in the range of 0.1 to 50% by weight, more preferably in the range of 0.5 to 30% by weight.

In addition, it is known that pigment-based charge generating agents show substantially different characteristic features including charge generating abilities and dispersibilities, respectively, depending on their different crystal structures. The differences of the crystal structures can be specifically defined by an X-ray diffraction spectrum or a differential scanning calorimeter.

More preferably, therefore, the charge generating agent of the present invention may be a titanyl phthalocyanine crystal having the maximum peak at a Bragg angle of $2\theta \pm 0.2° = 27.2°$ in the CuKα characteristic X-ray diffraction spectrum and having one peak generated at a temperature within the range of 270 to 400° C. in addition to another peak due to vaporization of absorbed water in a differential scanning calorimeter.

This is because a coating solution for a photosensitive layer having an excellent storage stability can be obtained depending on the fact that such given titanyl phthalocyanine crystal has an excellent charge generating ability as well as an excellent stability in an organic solvent. Therefore, for example, even in the case of using a coating solution for a photosensitive layer after seven or more days from the production thereof, an electrophotographic photoconductor having an excellent sensitive property can be produced more stably.

Furthermore, since the given titanyl phthalocyanine crystal shows an excellent dispersibility in the coating solution for a photosensitive layer, the generation of fogging can be effectively inhibited even when a large amount of an additive is used.

Hereinafter, the given titanyl phthalocyanine crystal will be further described independently for the optical characteristics and thermal characteristics thereof.

At first, with respect to the optical characteristics, as far as the titanyl phthalocyanine crystal is one having the maximum peak at a Bragg angle of $2\theta\pm0.2°=27.2°$, such a crystal may become a Y-type crystal having an excellent charge generating ability. Thus, titanyl phthalocyanine crystal is able to extensively increase the sensitive property thereof, compared with that of α- or β-type crystals.

Furthermore, with respect to the CuKα characteristic X-ray diffraction spectrum, the titanyl phthalocyanine crystal may preferably have no peak at a Bragg angle of $2\theta\pm0.2°=26.2°$. In addition, with respect to the CuKα characteristic X-ray diffraction spectrum, the titanyl phthalocyanine crystal may preferably have no peak at a Bragg angle of $2\theta\pm0.2°=7.4°$.

This is because such a configuration of the titanyl-phthalocyanine crystal is able to more firmly prevent the crystal from partially containing an α- or β-type crystal other than Y-type crystal.

In addition, the titanyl phthalocyanine crystal recovered after immersing in an organic solvent for 7 days may preferably have at least the maximum peak at a Bragg angle of $2\theta\pm0.2°=27.2°$, while having no peak at 26.2°.

This is because even after immersion in the organic solvent for 7 days the titanyl phthalocyanine crystal retains its characteristic features described above to firmly control the crystalline transformation thereof in the organic solvent.

By the way, the evaluation of an immersion experiment in an organic solvent, which acts as a standard for evaluating the storage stability of a titanyl phthalocyanine crystal may be preferably carried out, for example, under the same conditions as those for actually storing a coating solution for a charge generating layer to be used in the production of an electrophotographic photoconductor (hereinafter, referred to as a coating solution for a charge generating layer). Therefore, for example, it is preferable to evaluate the storage stability of the titanyl phthalocyanine crystal in a closed system under the conditions of 23±1° C. in temperature and 50 to 60% in relative humidity (RH).

Furthermore, the organic solvent, which can be employed for evaluating the storage stability of the titanyl phthalocyanine crystal, may be preferably at least one selected from a group consisting tetrahydrofuran, dichloromethane, toluene, 1,4-dioxan, and 1-methoxy-2-propanol.

This is because, when such an organic solvent is used as one in a coating solution for a charge generating layer, the stability of a given titanyl phthalocyanine crystal can be more firmly determined while allowing the given titanyl phthalocyanine crystal to show more favorable compatibility with a charge transfer agent, a binder resin, or the like. Therefore, an electrophotographic photoconductor capable of allowing the given titanyl phthalocyanine crystal, the charge transfer agent, and so on to exert their characteristic features more effectively, while allowing a stable production of the electrophotographic photoconductor having an excellent sensitive property.

Furthermore, with respect to the thermal characteristics of a given titanyl phthalocyanine crystal, a titanyl phthalocyanine crystal having one peak generated at a temperature within the range of 270 to 400° C. in addition to another peak due to vaporization of absorbed water in a differential scanning calorimeter, even in the case that it has been added to an organic solvent and left standing therein for a prolonged time period, the crystal structure can be effectively prevented from crystalline transformation to a α- or β-type crystal. Thus, by the use of such a titanyl phthalocyanine crystal, a coating solution for a charge generating layer having an excellent storage stability can be obtained. As a result, it leads to a stable production of an electrophotographic photoconductor having an excellent sensitive property.

Furthermore, by having such thermal characteristics, the titanyl phthalocyanine crystal is imparted with an improved dispersibility to a coating solution for a photosensitive layer. Therefore, even in the use of a large amount of an additive, the generation of fogging can be effectively prevented.

Furthermore, one peak generated at a temperature within the range of 270 to 400° C. in addition to another peak due to vaporization of absorbed water may be preferably found at a temperature within the range of 300 to 400° C.

Furthermore, a concrete method for measuring the CuKα characteristic X-ray diffraction spectrum and a concrete method for the differential scanning calorimeter will be described in examples described later.

In addition, in the CuKα characteristic X-ray diffraction spectrum, a titanyl phthalocyanine crystal, which shows the maximum peak at a Bragg angle of $2\theta\pm0.2°=27.2°$ in the CuKα characteristic X-ray diffraction spectrum and shows one peak generated at a temperature within the range of 270 to 400° C. in addition to another peak due to vaporization of absorbed water in a differential scanning calorimeter, can be prepared by the following steps (a) to (b):

(a) The step of preparing a titanyl phthalocyanine compound, where titanium alkoxide or titanium tetrachloride at a concentration of 0.40 to 0.53 moles per mole of o-phthalonitrile or a derivative thereof or 1,3-diimino isoindoline or a derivative thereof; and a urea compound at a concentration of 0.1 to 0.95 moles per mole of 1,3-diimino isoindoline or a derivative thereof are added and then reacted with each other to produce a titanyl phthalocyanine compound.

(b) The step of preparing a titanyl phthalocyanine crystal, where the titanyl phthalocyanine compound prepared in the step (a) is subjected to an acid treatment to produce a titanyl phthalocyanine crystal.

Hereinafter, the method for preparing the titanyl phthalocyanine crystal will be described in detail.

At first, as a method for preparing the titanyl phthalocyanine compound, it is preferable to produce a titanyl phthalocyanine compound by allowing o-phthalonitrile or a derivative thereof or 1,3-diimino isoindoline or a derivative thereof, provided as a raw material for the production of such a molecule, to react with titanium alkoxide or titanium tetrachloride in the presence of an urea compound.

Here, such a production method will be concretely described using a titanyl phthalocyanine compound represented by the formula (11) for illustrative purposes.

In other words, for preparing a titanyl phthalocyanine compound represented by the formula (11), it is preferable to carry out the production along the following reaction formula (1) or the following reaction formula (2).

Both the reaction formulae (1) and (2), titanium alkoxide used, but by way of example, may be a titanium tetrabutoxide compound represented by the formula (15).

Therefore, it is preferable to prepare a titanyl phthalocyanine compound as follows: As shown in the reaction formula (1), o-phthalonitrile represented by the formula (14) may be reacted with titanium tetrabutoxide as titanium alkoxide represented by the formula (15). Alternatively, as shown in the reaction formula (2), 1,3-diimino isoindoine represented by the formula (16) may be reacted with titanium alkoxide such as titanium tetrabutoxide represented by the formula (15).

By the way, in stead of titanium alkoxide such as titanium tetrabutoxide represented by the formula (15), titanium tetrachloride may be used.

Reaction Formula (1)

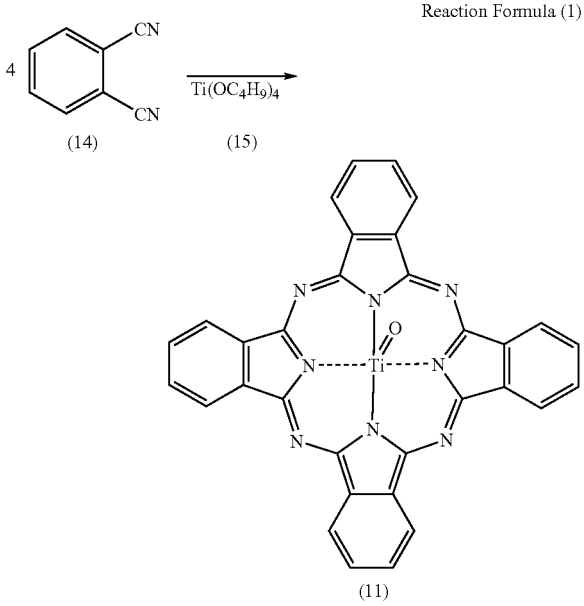

Reaction Formula (2)

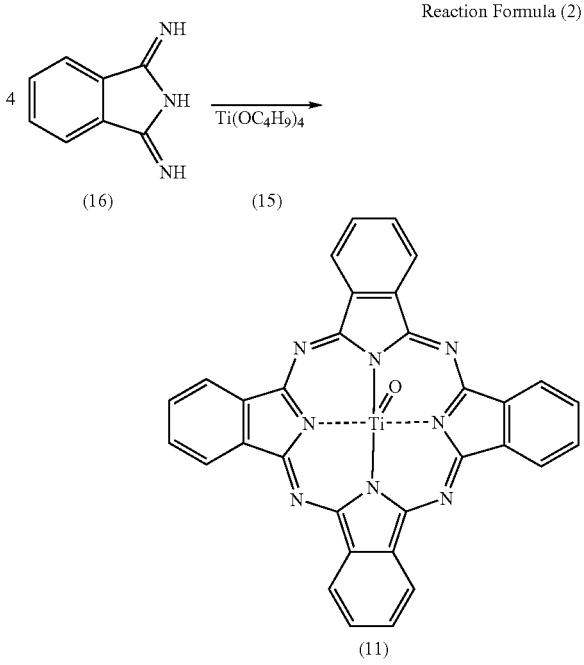

In addition, the amount of titanium alkoxide added, such as titanium tetrabutoxide represented by the formula (15), or the amount of titanium tetrachloride added may be preferably in the range of 0.40 to 0.53 moles per mole of o-phthalonitrile represented by the formula (14) or a derivative thereof or 3-diimino isoindoine represented by the formula (16) or a derivative thereof.

This is because the amount of titanium alkoxide added, such as titanium tetrabutoxide represented by the formula (15), or the amount of titanium tetrachloride added is an excess amount of over ¼ mole equivalent with respect to o-phthalonitrile represented by the formula (14) or a derivative thereof or 3-diimino isoindoine represented by the formula (16) or a derivative thereof to effectively exert an interaction with a urea compound described later. Here, such interaction will be described in the section of urea compounds.

Therefore, the amount of titanium alkoxide added, such as titanium tetrabutoxide represented by the formula (15), or the amount of titanium tetrachloride added may be preferably in the range of 0.43 to 0.5 moles per mole, more preferably in the range of 0.45 to 0.47 moles of o-phthalonitrile represented by the formula (14) or 1,3-diimino isoindoline represented by the formula (16)

Furthermore, the step (a) may be preferably carried out in the presence of a urea compound. This is because the use of a titanyl phthalocyanine compound prepared in the presence of the urea compound allows the urea compound and to exert an interaction with titanium alkoxide or titanium tetrachloride to effectively obtain a given titanyl phthalocyanine crystal.

In other words, ammonium generated by the reaction of the urea compound with titanium alkoxide or titanium tetrachloride further forms a complex with titanium alkoxide or titanium tetrachloride. Thus, such a substance acts to facilitate the reactions represented by the reaction formulae (1) and (2), respectively. Furthermore, on the basis of such a facilitatory action, the reaction of raw materials with each other leads to an effective production of titanyl phthalocyanine crystal, which is hardly subjected to crystalline transformation, even in the organic solvent.

Furthermore, the urea compound used in the step (a) may be preferably at least one selected from the group consisting of urea, thiourea, o-methylisourea sulfate, and o-methylisourea hydrochloride.

This is because such a urea compound is used as one included in each of the reaction formulae (1) and (2), so that ammonium produced during such a reaction can more effectively form a complex with titanium alkoxide or titanium tetrachloride to allow the substance to further facilitate the reaction represented by each of the reaction formulae (1) and (2).

In other words, this is because ammonium generated by reaction of the raw material, titanium alkoxide or titanium tetrachloride, with the urea compound may more effectively form a complex with titanium alkoxide or the like. Therefore, the complex compound further facilitates the reaction represented by each of the reaction formulae (1) and (2).

By the way, such a complex compound has been revealed so that it can be specifically generated when reacted under high-temperature conditions of 180° C. or more. For instance, it is more effective to carry out the reaction in quinoline (bp: 237.1° C.) or isoquinoline (bp. 242.5° C.), or a combination thereof (a weight ratio of 10:90 to 90:10).

Therefore, it is more preferable to use urea among the above urea compounds because ammonium as a reaction accelerator and a complex compound originated therefrom tend to be further produced.

Furthermore, the amount of the urea compound added, which is used in the step (a), may be preferably in the range of 0.1 to 0.95 moles per mole of o-phthalonitrile or a derivative thereof or 1,3-diimino isoindoline or a derivative thereof.

This is because the action of the urea compound described above can be more effectively exerted when the amount of the urea compound added is defined within such a range.

Therefore, the amount of the urea compound added may be more preferably in the range of 0.3 to 0.8 moles, still more preferably in the range of 0.4 to 0.7 moles per mole of o-phthalonitrile or a derivative thereof or 1,3-diimino isoindoline or a derivative thereof.

Furthermore, the solvent, which can be used in the step (a), may be one of or any combination of two or more of the group consisting of hydrocarbon solvents, such as xylene, naphthalene, methylnaphthalene, tetralin, and nitrobenzene; halogenated hydrocarbon solvents, such as dichlorobenzene, trichlorobenzene, dibromobenzene, and chloronaphthalene; alcohol solvents, such as hexanol, octanol, decanol, benzyl alcohol, ethylene glycol, and diethylene glycol; ketone solvents, such as cyclohexanone, acetophenone, 1-methyl-2-pyrrolidone, and 1,3-dimethyl-2-imidazolidinone; amido solvents, such as formamide and acetamide; and nitrogen-containing solvents, such as picoline, quinoline, and isoquinoline.

In particular, a nitrogen-containing compound having a boiling point of 180° C. or more, for example quinoline or isoquinoine, may be a suitable solvent because ammonium generated by the reaction of the raw material, titanium alkoxide or titanium tetrachloride, with an urea compound tends to further effectively form a complex compound with titanium alkoxide or the like.

Furthermore, it is preferable to define a reaction temperature in the step (a) to a higher temperature of 150° C. or more. This is because, if the reaction temperature is less than 150° C., specifically, if it becomes 135° C. or less, the raw material, titanium alkoxide or titanium tetrachloride, reacts with the urea compound, thereby causing difficulty in formation of a complex compound and it may become difficult to effectively prepare a titanyl phthalocyanine crystal having difficulty in crystalline transformation even in an organic solvent.

Therefore, the reaction temperature in the step of (a) is more preferably in the range of 180 to 250° C., still more preferably in the range of 200 to 240° C.

Furthermore, a reaction time in the step (a) may be preferably in the range of 0.5 to 10 hours depending on the reaction temperature. This is because, if the reaction temperature is less than 0.5 hour, the raw material, titanium alkoxide or titanium tetrachloride, is reacted with a urea compound to make the formation of a complex compound difficult. Therefore, the complex compound becomes difficult to further facilitate the reaction represented by each of the reaction formulae (1) and (2). As a result, it becomes difficult to effectively produce a titanyl phthalocyanine crystal which can be hardly subjected to crystalline transformation even in the organic solvent. On the other hand, such a reaction time exceeds 10 hours, it becomes economically disadvantage or the amount of the complex compound generated may decrease.

Therefore, the reaction time in the step (a) may be more preferably in the range of 0.6 to 3.5 hours, still more preferably in the range of 0.8 to 3 hours.

Subsequently, the titanyl phthalocyanine compound produced in the above step may be preferably subjected to an acid treatment as a post treatment to obtain a titanyl phthalocyanine crystal.

Therefore, as a pre-stage before carrying out the acid treatment, a step prior to the acid treatment may be preferably carried out such that the titanyl phthalocyanine compound obtained by the above reaction is added to an organic aqueous solvent and then stirred for a predetermined time under heat, and then it is left standing for a predetermined time at temperature lower than that of the stirring treatment to carry out a stabilization amount.

Furthermore, the organic aqueous solvent to be used in the step prior to the acid treatment may be one of or a combination of two or more of alcohols such as methanol, ethanol, and isopropanol, N,N-dimethyl formamide, N,N-dimethyl acetoamide, propionic acid, acetic acid, N-methyl pyrrolidone, and ethyl glycol. In addition, the organic aqueous solvent may be added with an organic nonaqueous solvent as far as in small amounts.

Furthermore, the conditions of the stirring treatment in the step prior to the acid treatment are not specifically limited. However, the stirring treatment may be preferably carried out under predetermined temperature conditions of about 70 to 200° C. for about 1 to 3 hours.

Furthermore, the stabilization treatment after the stirring treatment is also not specifically limited. However, the stabilization reaction may be preferably carried out under predetermined temperature conditions of about 23±1° C. by leaving the solution standing for about 5 to 15 hours to stabilize.

Next, the acid treatment step may be preferably carried out as follows.

The titanyl phthalocyanine crystal obtained in the step prior to the acid treatment is dissolved in acid and then recrystallized by dropwisely dropping the solution into water. Then, the resultant titanyl phthalocyanine crystal may be preferably washed in an aqueous alkaline solution. Specifically, the resultant crude crystal is dissolved in acid and the solution is then stirred after a predetermined time after dropping ice-cold water into the solution. After that, the solution may be preferably left standing at a temperature of 15 to 30° C. to crystallize. Subsequently, in an undried state in the presence of water, the resultant crystal may be preferably stirred in a nonaqueous solvent at 30 to 70° C. for 2 to 8 hours.

Furthermore, the acids, which can be used in the acid treatment, may preferably include concentrated sulfuric acid, trifluoroacetic acid, and sulfonic acid.

This is because impurities can be sufficiently decomposed using such a strong acid in the acid treatment, while the given titanyl phthalocyanine crystal can be prevented from decomposition. Therefore, a titanyl phthalocyanine crystal having a high purity as well as excellent characteristic features thereof was obtained.

Furthermore, the aqueous alkali solution used in the wash treatment may be preferably a typical aqueous alkali solution, such as an aqueous ammonium solution and an aqueous sodium hydrate solution.

This is because the given titanyl phthalocyanine crystal after the acid treatment is washed with an aqueous alkali solution to sift the environment of the crystal to acidic to neutral. As a result, the handling of such a crystal in the subsequent step can be easily handled while the stability of the crystal can be enhanced.

Furthermore, the nonaqueous solvent for the stirring treatment may be, for example, a halogen solvent such as chlorobenzene or dichloromethane.

(3) Binding Resin

Regarding the type of a binding resin that constitutes the charge generating layer, it is characterized in that a plurality of polycarbonate resins is used when the charge generating layer corresponds to the surface layer of the photoconductor.

This is because such a configuration of the charge generating layer allows the binding resin to exert a more effective interaction with a plasticizer component. That is, the plasticizer component may selectively blended with one polycarbonate resin in a compatible manner while it may be incompatible with the other polycarbonate resin. Therefore, the above configuration of the binding resin can effectively prevent the generation of cracks and crystallization due to the sticking of finger oil or the like while retaining mechanical strength and endurance by maintaining the good endurance and abrasion resistance as well as the good sensitive property.

By the way, the details of the binding resin will be further described in the section for a charge transfer layer described later.

(4) Plasticizer Component

Furthermore, it is characterized in that the photosensitive layer contains a biphenyl derivative having a given structure as a plasticizer component.

This is because the use of such a plasticizer component allows the photosensitive layer to exert an interaction with the binding resin more effectively.

In other words, such a plasticizer component can be selectively blended with the other polycarbonate resin in a compatible manner. Therefore, the plasticizer component can effectively prevent the generation of cracks and crystallization due to the sticking of finger oil or the like while retaining mechanical strength and endurance. By the way, the details of the plasticizer component will be further described in the section for a charge transfer layer described later.

Furthermore, the amount of such a plasticizer component added may be preferably in the range of 1 to 30 parts by weight with respect to 100 parts by weight of the binding resin.

This is because the plasticizer component becomes difficult to be selectively blended with the other polycarbonate resin when the amount of the plasticizer component added is less than 1 part by weight. In contrast, when the amount of the plasticizer component added exceeds 30 parts by weight, the selectivity thereof may decrease to cause significant reductions in mechanical strength and endurance.

Therefore, the amount of the plasticizer component added may be preferably in the range of 2 to 20 parts by weight, more preferably in the range of 3 to 15 parts by weight with respect to 100 parts by weight of the binding resin.

4. Charge Transpfer Layer (1) Basic Configuration

The charge transfer layer may be preferably formed by uniformly dispersing a charge transfer agent (hole transfer agent) together with an organic solvent and a binding resin, followed by subjecting to coating.

Therefore, for forming the charge transfer layer, the mixing ratio of the charge transfer agent to the binding resin may be preferably in the range of 10:1 to 1:5.

In addition, the film thickness of the charge transfer layer may be generally in the range of 2 to 100 μm, preferably in the range of 5 to 50 μm.

(2) Hole Transfer Agent (2)-1 Types

The hole transfer agent to be used in the charge transfer layer of the present invention include various kinds of conventionally known compounds. Specifically, the compound include benzidine compounds, phenylene diamine compounds, naphthylene diamine compounds, phenantolylene diamine compounds, oxadiazole compounds, styryl compounds, carbazole compounds, pyrazoline compounds, hydrazone compounds, triphenylamine compounds, indol compounds, oxazole compounds, isooxazole compounds, thiazole compounds, thiadiazole compounds, imidazole compounds, hydrazole compounds, triazole compounds, butadiene compounds, pyrene-hydrazole compounds, acrolein compounds, carbazole-hydrazole compounds, quinoline-hydrazone compounds, stilbene compounds, stilbene-hydrazone compounds, and diphenylene diamine compounds, which can be used independently or in combination of two or more thereof.

(2)-2 Concrete Example 1

Furthermore, the concrete examples of the hole transfer agent include compounds represented by the following general formulae (17) to (20).

(14)

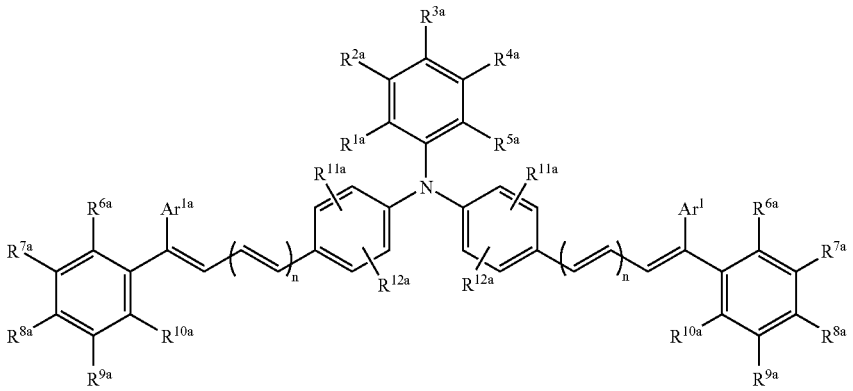

(In the general formula (17), $R^{1a}$ to $R^{12a}$ each independently represent a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, a group represented by —$OR^{13a}$ ($R^{13a}$ represents an alkyl or perfluoroalkyl group having 1 to 10 carbon atoms, or an aryl group having 6 to 30 carbon atoms), $R^{1a}$ to $R^{5a}$, $R^{6a}$ to $R^{10a}$, and $R^{11a}$ and $R^{12a}$ may respectively form saturated or unsaturated rings by binding two of their substitutes each other, $Ar^{1a}$ represents a hydrogen atom, a substituted or unsubstituted alkyl group having 1 to 12 carbon atoms, a substituted or unsubstituted aryl group having 6 to 30 carbon atoms, and n represents an integer of 1 to 2).

(15)

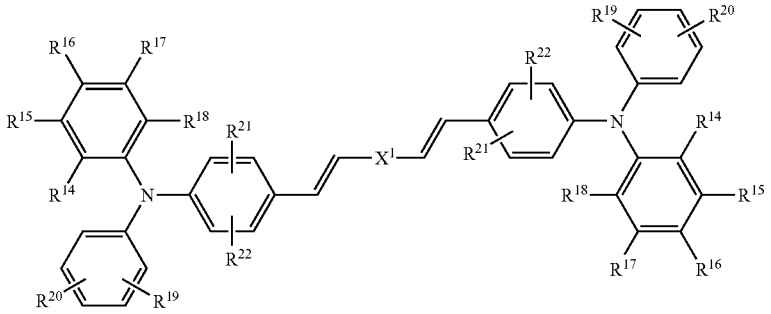

(In the general formula (18), $R^{14}$ to $R^{22}$ each independently represent a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, a group represented by —$OR^{23}$ ($R^{23}$ represents an alkyl or perfluoroalkyl group having 1 to 10 carbon atoms, or an aryl group having 6 to 30 carbon atoms), $R^{14}$ to $R^{18}$, $R^{19}$ and $R^{20}$, and $R^{21}$ and $R^{22}$ may respectively form saturated or unsaturated rings by binding two of their substitutes each other, and $X^1$ represents a substituted or unsubstituted arylen group having 6 to 30 carbon atoms, or an unsaturated hydrocarbon group including a aryl group having 6 to 30 carbon atoms, or a condensed multi-ring hydrocarbon structure having 10 to 30 carbon atoms).

Furthermore, $R^{16}$ and $R^{20}$ may be a substituent represented by the following general formula (18') in addition to the above substituents.

(15')

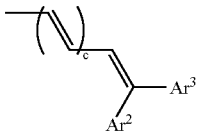

(In the general formula (18'), $Ar^2$ and $Ar^3$ each independently represents a hydrogen atom, a substituted or unsubstituted alkyl group having 1 to 12 carbon atoms, substituted or unsubstituted aryl group having 6 to 30 carbon atoms, and c is an integer of 0 to 2).

(16)

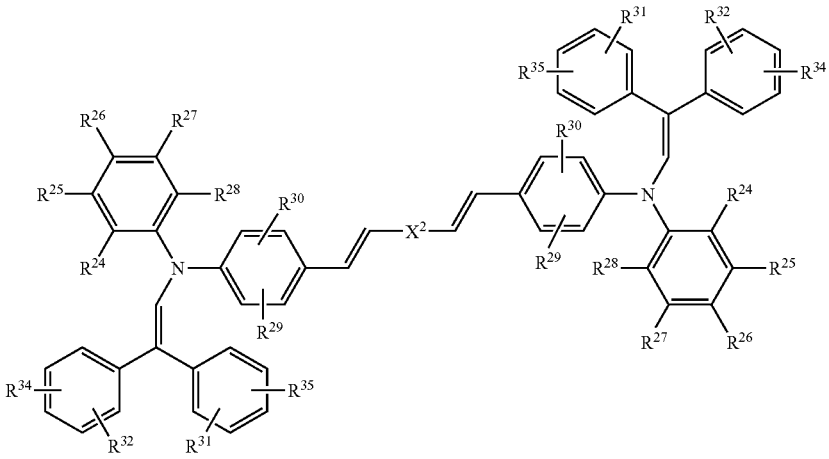

(In the general formula (19), $R^{24}$ to $R^{35}$ each independently represents a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, —$OR^{36}$ ($R^{36}$ represents an alkyl or perfluoroalkyl group having 1 to 10 carbon atoms, or an aryl group having 6 to 30 carbon atoms), $R^{24}$ to $R^{28}$, $R^{29}$ and $R^{30}$, and $R^{31}$ and $R^{32}$ may respectively form saturated or unsaturated rings by binding two of their substitutes each other, and $X^2$ represents a substituted or unsubstituted arylen group having 6 to 30 carbon atoms, or an unsaturated hydrocarbon group including a aryl group having 6 to 30 carbon atoms, or a condensed multi-ring hydrocarbon structure having 10 to 30 carbon atoms).

Furthermore, $R^{26}$ may be a substituent represented by the following general formula (19') in addition to any of the above substituents.

(16')

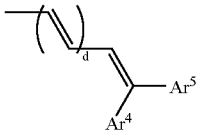

(In the general formula (19'), $Ar^4$ and $Ar^5$ each represents a hydrogen atom, a substituted or unsubstituted alkyl group having 1 to 12 carbon atoms, a substituted or unsubstituted aryl group having 6 to 30 carbon atoms, and d represents an integer of 0 to 2).

(17)

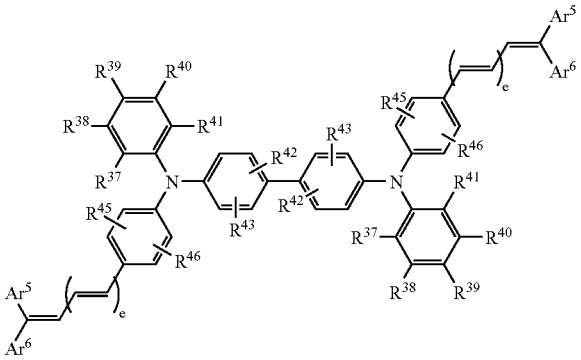

(In the general formula (20), $R^{37}$ to $R^{46}$ each independently represent a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, —$OR^{47}$ ($R^{47}$ represents an alkyl or perfluoroalkyl group having 1 to 10 carbon atoms, or an aryl group having 6 to 30 carbon atoms), and $R^{37}$ to $R^{41}$, $R^{42}$ and $R^{43}$, and $R^{45}$ and $R^{46}$ may respectively form saturated or unsaturated rings by binding two of their substitutes each other, $Ar^4$ and $Ar^5$ each represent a hydrogen atom, a substituted or unsubstituted alkyl group having 1 to 12 carbon atoms, a substituted or unsubstituted aryl group having 6 to 30 carbon atoms, and e represents an integer of 0 to 2).

Preferably, furthermore, the hole transfer agent may have a molecular weight in the range of 300 to 2,000.

This is because the use of the hole transfer agent having such a molecular weight range reduces variations in film thickness and retains the sensitive property of the photoconductor layer not only initial stages but also after carrying out a given continuous printing.

Furthermore, the hole transfer agent having such a molecular weight range is not only easy to handle but also excellent in endurance with less crystallization.

Therefore, among the concrete examples of the hole transfer agent described above, any compound having a molecular weight of 300 to 2,000 is more preferable.

By the way, the molecular weight of the hole transfer agent can be calculated, for example, on the basis of its structural formula, or can be determined using a mass spectrum obtained by a mass spectrometer.

(2)-3 Concrete Example 2

Furthermore, the concrete examples of the hole transfer agent include compounds represented by the following formulae (21) to (24) (HTM-1 to 4).

(18)

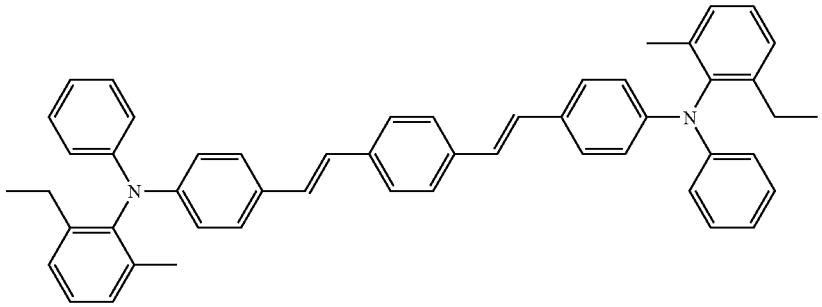

(HTM-1)

-continued
(19)
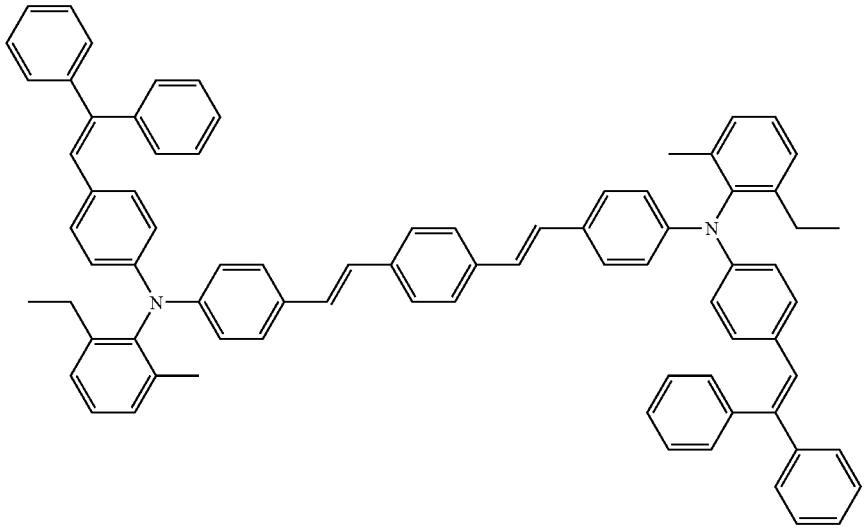
(HTM-2)
(20)
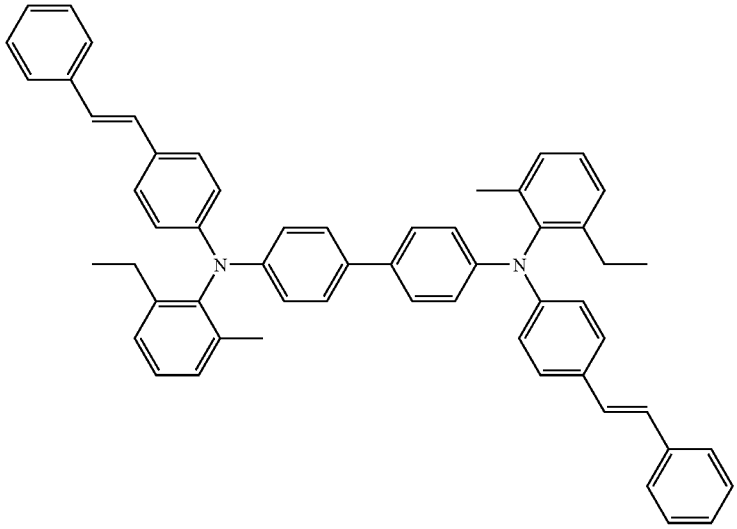
(HTM-3)
(21)
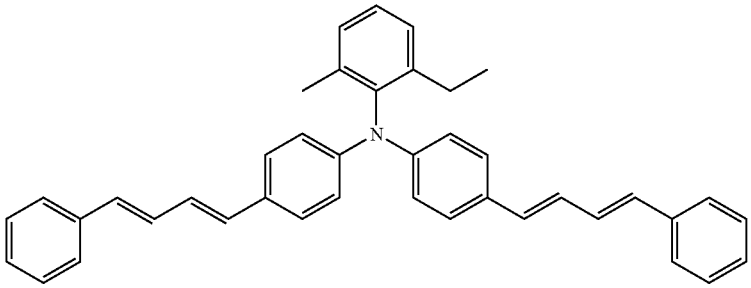
(HTM-4)

(2)-4 Amount Added

Furthermore, it is characterized in that the amount of the hole transfer resin added is in the range of 1 to 100 parts by weight with respect to 100 parts by weight of the binding resin.

This is because, when the amount of the hole transfer agent added is less than 1 part by weight, the sensitivity of the photoconductor layer cannot be retained after carrying out a given continuous printing.

In contrast, when the amount of the hole transfer agent added exceeds 100 parts by weight, it may become difficult to be uniformly mixed and dispersed or may tend to crystallize.

Therefore, the addition amount of the hole transfer agent added may be preferably in the range of 5 to 80 parts by weight, more preferably in the range of 10 to 50 parts by weight with respect to 100 parts by weight of the binding resin.

(3) Binding Resin (3)-1 Average Molecular Weight

It is characterized in that, for the type of the binding resin that constitutes the charge transfer layer, a plurality of polycarbonate resins is employed when the charge transfer layer corresponds to the surface layer.

In this case, the average molecular weight of the plurality of polycarbonate resins is not particularly limited. For instance, however, it is preferable to make the plurality of polycarbonate resins to have different average molecular weights such that one of the polycarbonate resins may have a larger average molecular weight, while the other of the polycarbonate resins may have a smaller average molecular weight.

This is because such a configuration of the plurality of polycarbonate resins is allowed to exert an effect of being selectively blended with a certain molecular structure in a compatible manner as described above. In other words, the plasticizer component is selectively blended with the polycarbonate resin having a comparatively small average molecular weight in a compatible manner, while it cannot be selectively blended with a comparatively large average molecular weight. More specifically, it is preferable to use a polycarbonate resin having an average molecular weight of 40,000 or more in combination with a polycarbonate resin having an average molecular weight of less than 40,000.

(3)-2 Blending Ratio

Furthermore, for the combined use of a plurality of polycarbonate resins, it is preferable that, when the amount of one of the polycarbonate resin is 100 parts by weight, the other thereof may be in the range of 10 to 80 parts by weight.

For instance, when the amount of one of the polycarbonate resins added, which is represented by the formula (8) or (9), is 100 parts by weight, the amount of the other polycarbonate resin added and which is represented by the formula (7) may be preferable in the range of 10 to 80 parts by weight.

This is because, when the amount of the polycarbonate resin of the formula (7) added is less than 10 parts by weight, it may become difficult to exert an interaction with a plasticizer component. In addition, when the amount of the polycarbonate resin of the formula (7) added exceeds 80 parts by weight, the amount of the polycarbonate resin of the formula (8) or (9) added may relatively decrease to extensively lower the endurance, abrasive resistance, or the like of the photoconductor.

Therefore, it is more preferable that, with respect to 100 parts by weight of one of the polycarbonate resins, the amount of the other polycarbonate resin added is in the range of 20 to 50 parts by weight.

(3)-3 Types

Furthermore, one of the characteristic features of the present invention is to employ a plurality of polycarbonate resins having different molecular structures. This is because the plurality of polycarbonate resins having different molecular structures can further effectively exert an interaction with the plasticizer component.

In other words, for instance, the plasticizer component is selectively blended with a polycarbonate resin containing a cyclic-ring structure as represented in the formula (8) or a polycarbonate resin having an asymmetric structure in the center portion thereof as shown in the formula (9) in a compatible manner, while it is comparatively difficult to be blended with a polycarbonate resin made of a copolymer as represented by the formula (7) in a compatible manner.

Therefore, the use of a plurality of polycarbonate resin having different molecular structures can effectively prevent the generation of cracks and crystallization due to the sticking of finger oil or the like, while retaining mechanical strength and endurance.

In addition, as a favorable example of the polycarbonate resin having a structural unit represented by the general formula (7), any of polycarbonate resins represented by the formulae (25) to (27) can be exemplified.

Furthermore, as a favorable example of the polycarbonate resin having a structural unit represented by the general formula (8) or (9), a polycarbonate resin represented by the formula (28) to (30) can be exemplified.

(22)

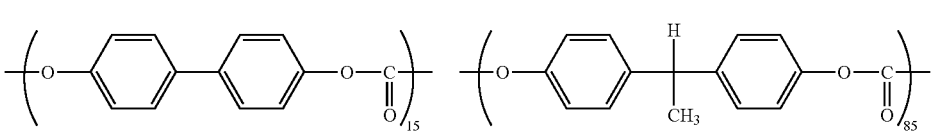

(Resin-1)

(23)

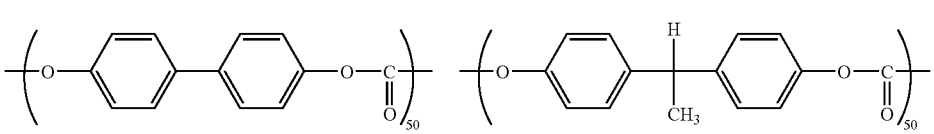

(Resin-2)

-continued (24)

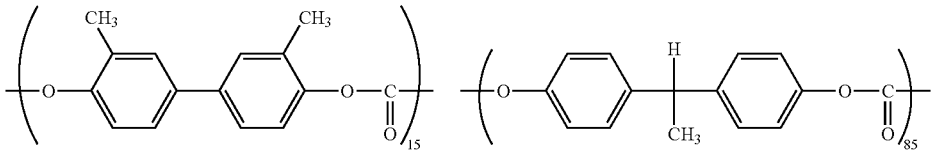

(Resin-3)

(25)

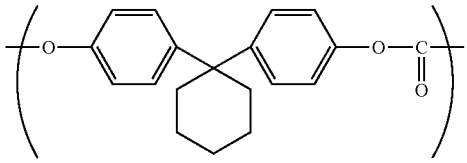

(Resin-4)

(26)

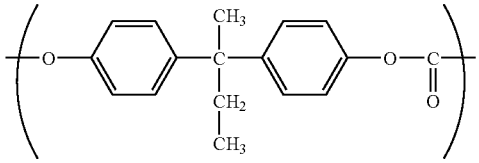

(Resin-5)

(27)

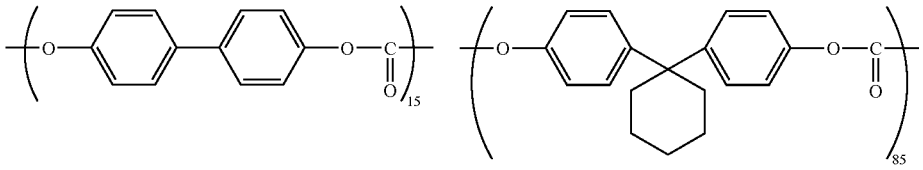

(Resin-6)

Other examples of the binding resin that constitutes the charge transfer layer include, other than the polycarbonate resins described above, any of various resins, which have been conventionally used for photosensitive layers, can be concurrently used. The resins which can be used include thermoplastic resins, such as polyester resins, polyalylate resins, styrene-butadiene copolymers, styrene-acrylonitrile copolymers, styrene-maleic acid copolymers, acrylic copolymers, styrene-acrylic acid copolymers, polyethylene, ethylene-vinyl acetate copolymers, chlorinated polyethylene, polyvinyl chloride, polypropylene, ionomeers, vinyl chloride-vinyl acetate copolymers, alkyd resins, polyamide, polyurethane, polysulfone, diallyl phthalate resins, ketone resins, polyvinyl butyral resins, and polyether resins; and cross-linkable thermosetting resins, such as silicon resins, epoxy resins, phenol resins, urea resins, and melamine resins; and photocurable resins, such as epoxyacrylate resins and urethane-acrylate resins.

(4) Plasticizer Component

Furthermore, it is characterized in that the photosensitive layer contains a biphenyl derivative having a given structure as a plasticizer component represented by the formula (1), when the charge transfer layer is the outside surface layer according to the photoconductor of the present invention.

This is because such a plasticizer component can be selectively blended with the other polycarbonate resin in a compatible manner. Therefore, the plasticizer component can effectively prevent the generation of cracks and crystallization due to the sticking of finger oil or the like while retaining mechanical strength and endurance by maintaining the good endurance and abrasion resistance as well as the good sensitive property.

The following plasticizer components are preferably a compound represented by the formula (31) or any of derivatives thereof (BP-1 to BP-22).

(31)

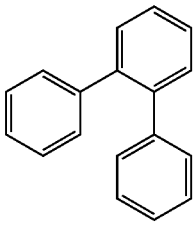

(BP-1)

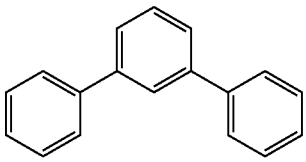

(BP-2)

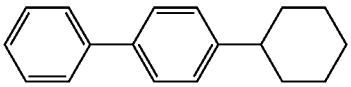

(BP-3)

-continued

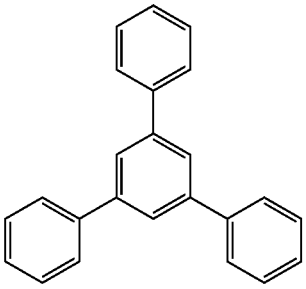

(BP-4)

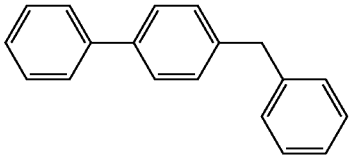

(BP-5)

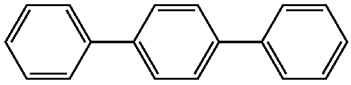

(BP-6)

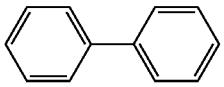

(BP-7)

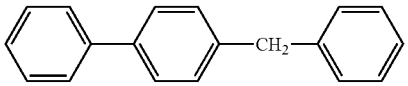

(BP-8)

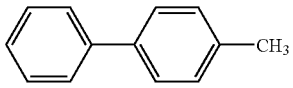

(BP-9)

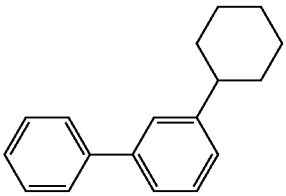

(BP-10)

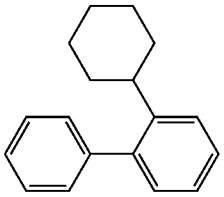

(BP-11)

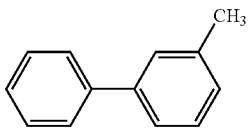

(BP-12)

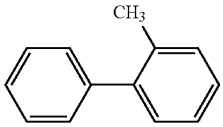

(BP-13)

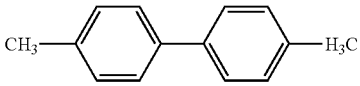

(BP-14)

-continued

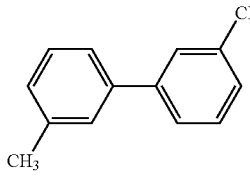

(BP-15)

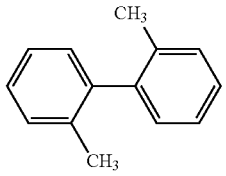

(BP-16)

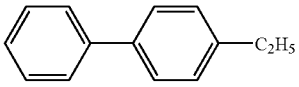

(BP-17)

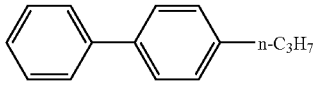

(BP-18)

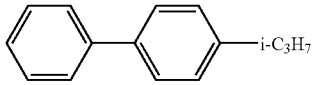

(BP-19)

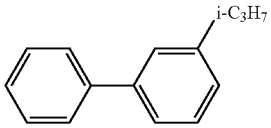

(BP-20)

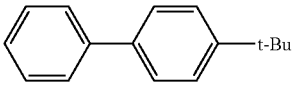

(BP-21)

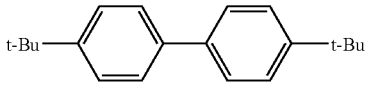

(BP-22)

In addition, the amount of such a plasticizer component added may be preferably in the range of 1 to 30 parts by weight with respect to 100 parts by weight of the binding resin in the charge transfer layer.

This is because, when the amount of the plasticizer component added is less than 1 part by weight, it may become difficult to be selectively blended with one of the polycarbonate resins in a compatible manner. In contrast, when the amount of the plasticizer component added exceeds 30 parts by weight, the percentage of the plasticizer component to be selectively blended with the other polycarbonate resin in a compatible manner may increase to extensively lower the mechanical strength and endurance of the photoconductor.

Therefore, the amount of the plasticizer component added may be preferably in the range of 2 to 20 parts by weight, more preferably in the range of 3 to 15 parts by weight with respect to 100 parts by weight of the binding resin in the charge transfer layer.

Figure 2:
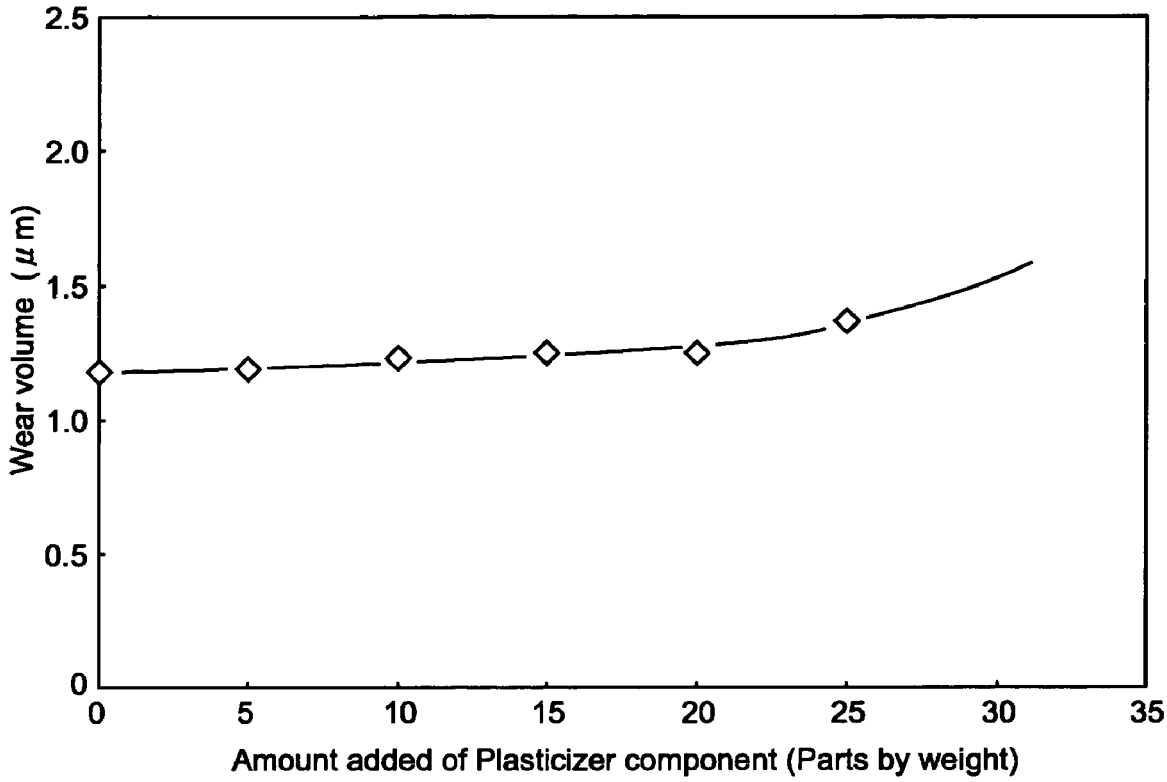
FIG. 2 is a diagram including the characteristic curb for illustrating the relationship between the amount of plasticizer component and the abrasion resistance.

Referring now to FIG. 2, the relationship between the amount of a plasticizer component added in the charge transfer layer and the wear volume of the electrophotographic photoconductor will be described.

FIG. 2 represents the amount of a plasticizer component added (part by weight) with respect to 100 parts by weight of a binder resin in the charge transfer layer plotted on the horizontal axis, and the characteristic curve of the electrophotographic photoconductor with plotted wear volumes (μm) on the vertical axis.

As is evident from the characteristic curve, when the amount of the plasticizer component added increases from 0 to 30 parts by weight, the wear volume (μm) slightly increases but being stably retained at about 1.5 μm or less. On the other hand, when the amount of the plasticizer component added exceeds 30 parts by weight, the rate of an increase in wear volume (μm) gradually increases. As a result, it is found that a given abrasion resistance cannot be stably retained.

The causes of such phenomena may be, as described above, difficulty in selective compatibility of the plasticizer, which results in disruption of a balance in relationship between a plurality of polycarbonate resins and the plasticizer.

Furthermore, the additive used was the compound (BP-2) represented by the general formula (3). In addition, methods for determining the composition and wear volume of the electrophotographic photoconductor will be concretely described in Example 1 illustrated in the later.

Figure 3:
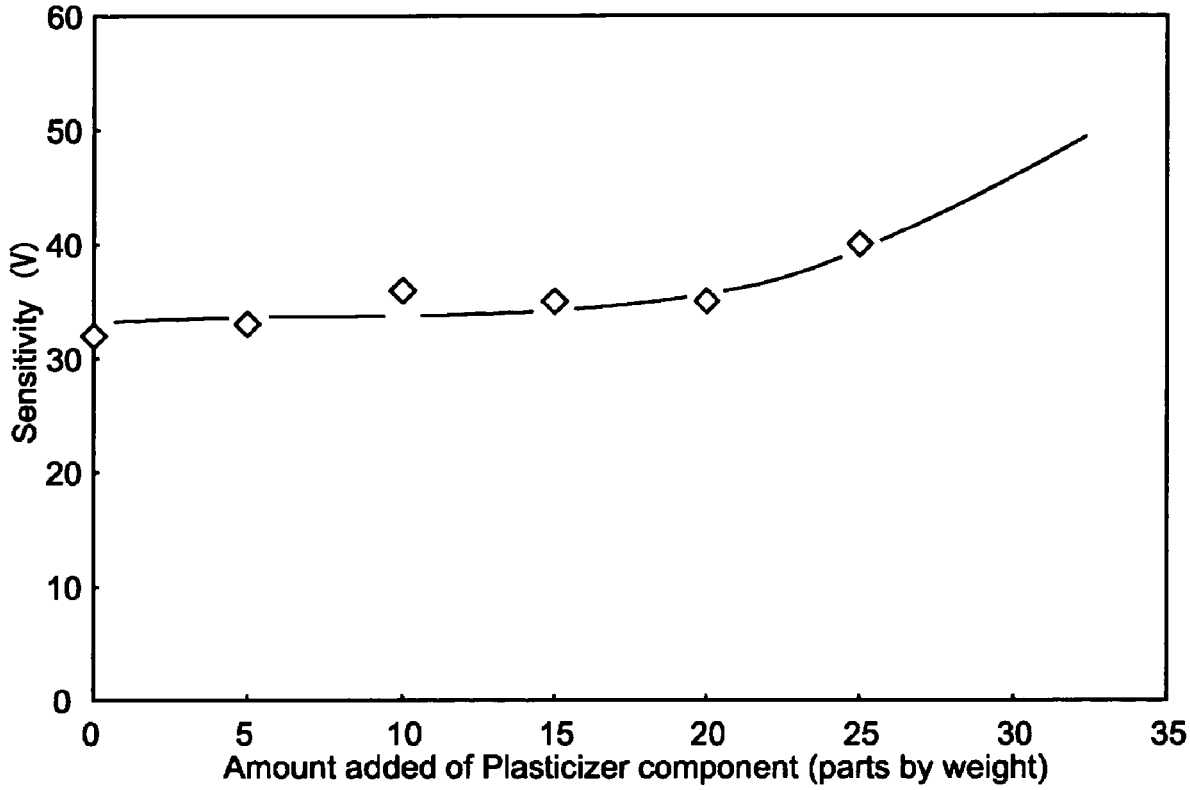
FIG. 3 is a diagram including the characteristic curb for illustrating the relationship between the amount of plasticizer component and sensitivity.

Referring now to FIG. 3, the relationship between the amount of the plasticizer component added of the charge transfer layer and the sensitivity such as the sensed potential in the electrophotographic photoconductor will be described.

In FIG. 3, the amount of the plasticizer added with respect to 100 parts by weight of the binder resin in the charge transfer layer is plotted on the horizontal axis, while the absolute value (V) of the sensed potential of the electrophotographic photoconductor is plotted on the vertical axis and represented as a characteristic curve. The smaller the absolute value (V) of the sensed potential, the superior the sensitivity property of the electrophotographic photoconductor becomes.

As is evident from the characteristic curve, when the amount of the plasticizer component added increases from 0 to 30 parts by weight, the absolute value of the sensed potential (V) slightly increases but being stably retained at slightly higher than 30 V. On the other hand, when the amount of the plasticizer component added exceeds 30 parts by weight, the rate of an increase in absolute value of the sensed potential (V) gradually increases. As a result, it is found that a given sensed potential cannot be stably retained.

The causes of such phenomena may be, as described above, similar to the content of the description about the relationship with the amount of the plasticizer added and the wear volume of the electrophotographic photoconductor.

In addition, methods for determining the composition and sensed potential of the electrophotographic photoconductor, as well as the additive, or the like will be concretely described in Example 1 illustrated in the later.

Figure 4:
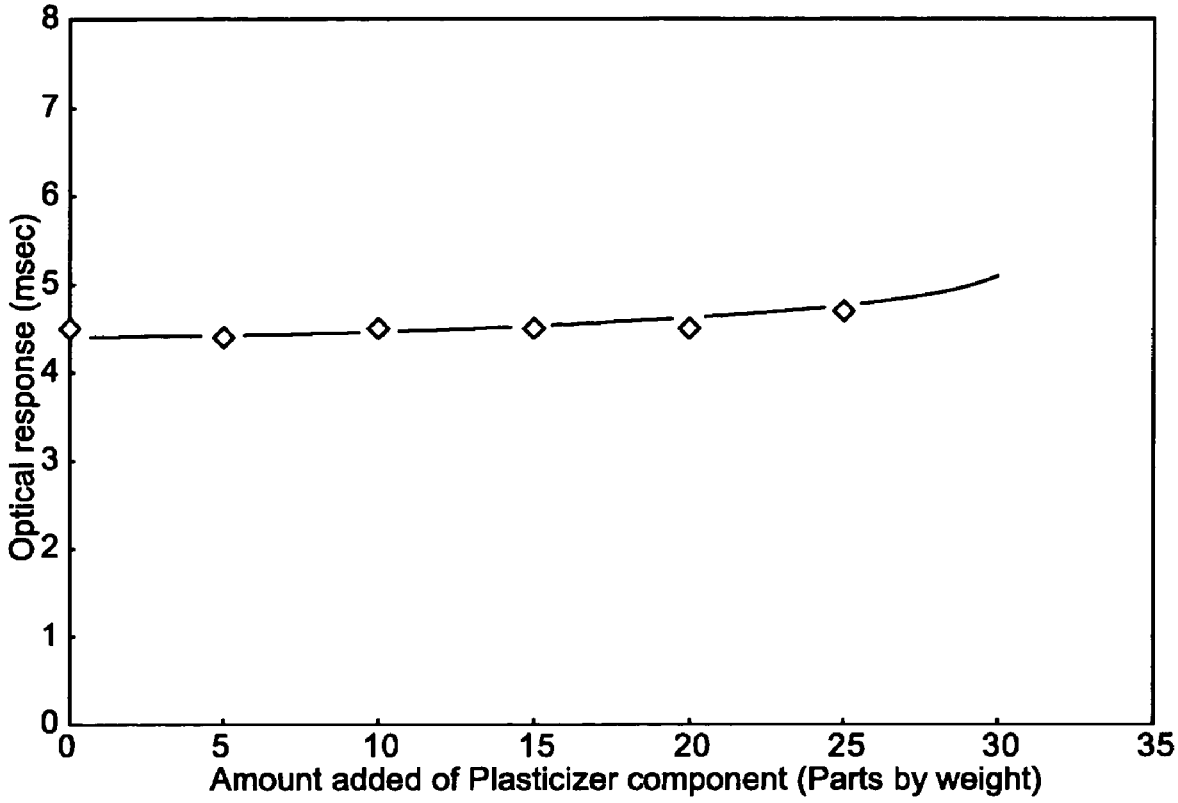
FIG. 4 is a diagram including the characteristic curb for illustrating the relationship between the amount of plasticizer component and optical response.

Referring now to FIG. 4, the relationship between the amount of the plasticizer component added in the charge transfer layer and the optical response of the electrophotographic photoconductor will be described.

In FIG. 4, the amount of the plasticizer with respect to 100 parts by weight of the binder resin of the charge transfer layer is plotted on the horizontal axis, while the optical response (msec) of the electrophotographic photoconductor is plotted on the vertical axis and represented as a characteristic curve. The smaller the optical response (msec), the superior the optical response as the sensitivity property of the electrophotographic photoconductor becomes.

As is evident from the characteristic curve, when the amount of the plasticizer component added increases from 0 to 30 parts by weight, the optical response value (msec) slightly increases but being stably retained at about 4.5 msec. On the other hand, when the amount of the plasticizer added exceeds 30 parts by weight, the rate of an increase in optical response (msec) gradually increases. As a result, it is found that a given optical response cannot be stably retained.

The causes of such phenomena may be, as described above, similar to the content of the description about the relationship with the amount of the plasticizer added and the wear volume or optical response of the electrophotographic photoconductor.

In addition, methods for determining the composition and optical response of the electrophotographic photoconductor, as well as the additive, or the like will be concretely described in Example 1 illustrated in the later.

Furthermore, as a plasticizer, it is preferable to add a triphenyl amine compound represented by the following formula (32) (TPA-1 to TPA-21) in addition to a biphenyl derivative represented by the formula (31) or the like.

This is because the compatibility of the plasticizer component with a plurality of the polycarbonate resins can be easily adjusted to allow the plasticizer component and the polycarbonate resin to more effectively exert their relationship.

Furthermore, preferably, the amount of the triphenyl amine compound added may be preferably defined such that the total amount with the biphenyl derivative represented by the general formula (1) does not exceed 30 parts by weight with respect to 100 parts by weight of the binder resin of the charge transfer layer and the amount of the biphenyl derivative, the triphenyl amine compound, may be in the range of 90:10 to 10:90.

(32)

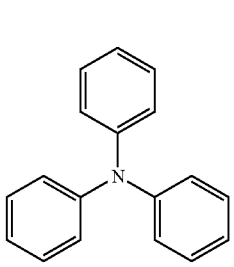

(TPA-1)

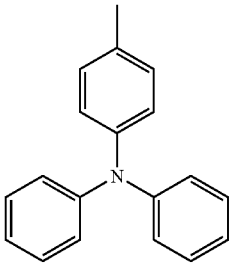

(TPA-2)

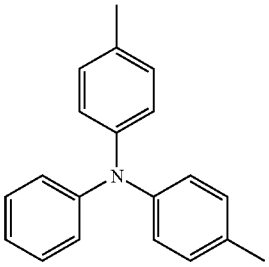

(TPA-3)

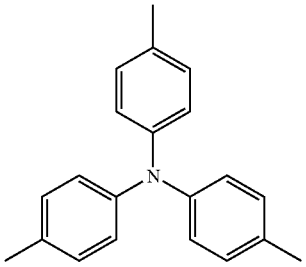

(TPA-4)

-continued
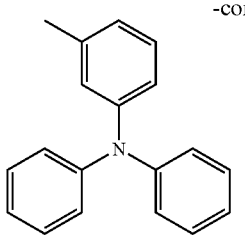
(TPA-5)
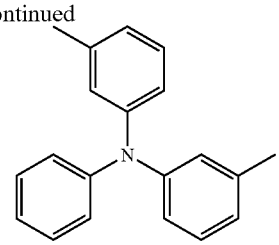
(TPA-6)
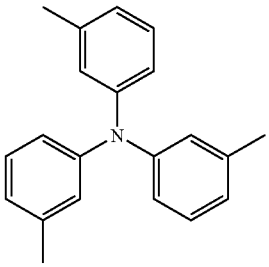
(TPA-7)
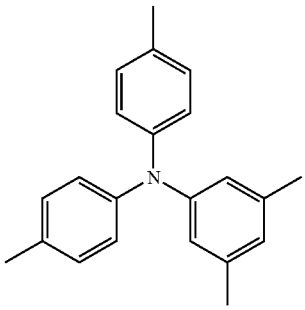
(TPA-8)
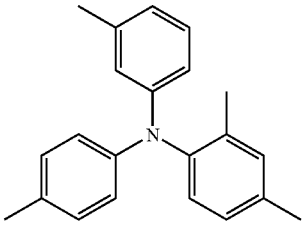
(TPA-9)
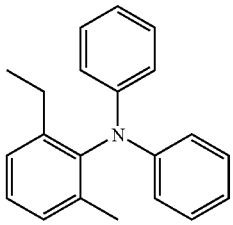
(TPA-10)
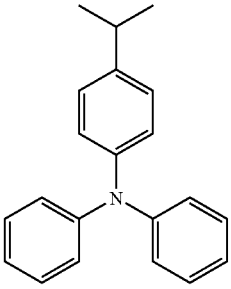
(TPA-11)
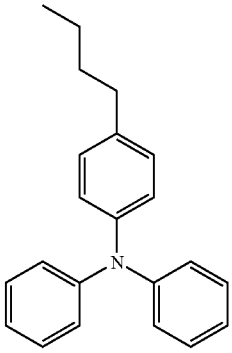
(TPA-12)
-continued
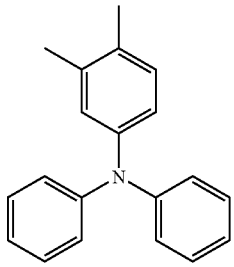
(TPA-13)
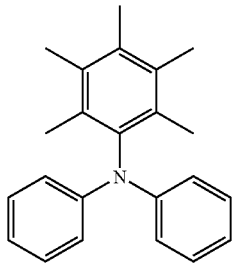
(TPA-14)
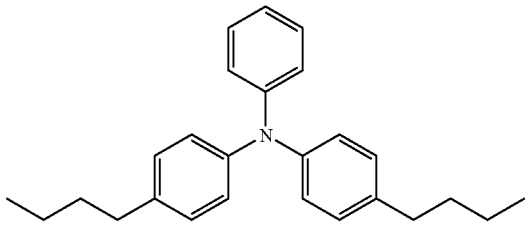
(TPA-15)
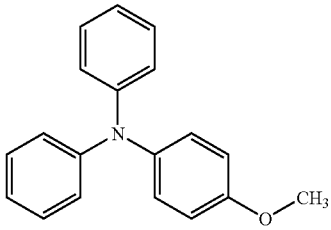
(TPA-16)
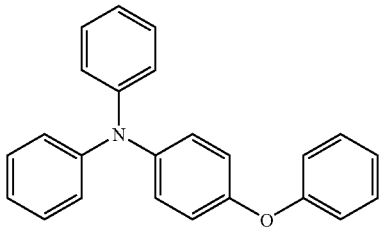
(TPA-17)
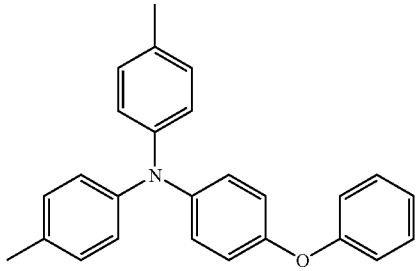
(TPA-18)

-continued

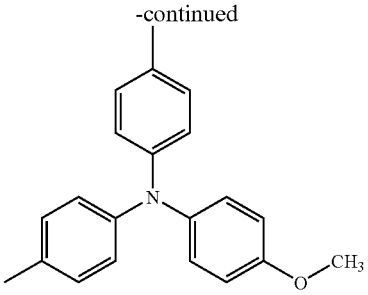

(TPA-19)

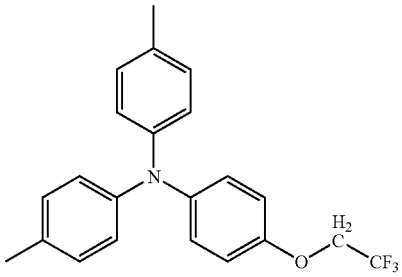

(TPA-20)

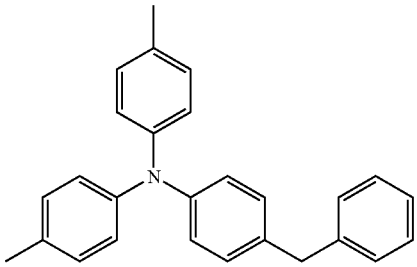

(TPA-21)

(5) Additives

Furthermore, in addition to each of the above components, any of various additives known in the art may be used. For instance, antioxidants include hindered phenols, hindered amines, paraphenylene diamines, aryl alkanes, hydroquinones, spirochromanes, spiroindanones, and derivatives thereof, as well as organic sulfur compounds and organic phosphorus compounds. In addition, light stabilizers include derivatives of benzophenones, benzotriazoles, dithiocarbamates, and tetramethyl piperidines. Any of other additives including deterioration-preventing agents, such as radical scavenging agents, singlet-quenching agents, and UV absorbers; softening agents, plasticizers, surface modifiers, fillers, thickeners, dispersion stabilizers, waxes, acceptors, and donors, can be blended. In addition, for improving the sensitivity of the photosensitive layer, for example, any of the conventionally known sensitizers, such as halonaphthoquinones and acenaphthoquinones, may be used in combination with the charge generating agent.

(6) Characteristics of Photoconductor (6)-1 95% Response Time

Furthermore, the photosensitive layer may preferably have a 95% response time of 20 msec or less (a time period required for attaining an electrostatic voltage of 130 V at a light exposure of 780 nm in wavelength, which corresponds to an electrostatic voltage of 100 V reached after 300 msec from electrification under the conditions of 700 V at 23° C.).

This is because such a configuration of the photosensitive layer allows the photosensitive layer to stably obtain a given sensitive property.

Therefore, the 95% response time of the photosensitive layer may be more preferably 15 msec or less, still more preferably within 10 msec or less.

(6)-1 Glass Transition Point

Furthermore the photosensitive layer may preferably have a glass transition point (DSC measurement) of 65° C. or more.

Such a configuration of the photosensitive layer allows the photoconductor to obtain stably improved abrasion resistance and sensitive properties while effectively preventing a given sensitive property due to the sticking of finger oil or the like.

Therefore, the glass transition point of the photosensitive layer may be more preferably in the range of 70 to 120° C., still more preferably in the range of 75 to 100° C.

(7) Manufacturing Method

Furthermore, for instance, a method for manufacturing a multilayer-type electrophotographic photoconductor may preferably contain the following steps (a) to (c), but not specifically limited thereto.

(a) the step of forming an intermediate layer on a conductive support (this step may be also referred to as a step of forming an intermediate layer);

(b) the step of coating a coating solution for a charge generating layer, which contains a binding resin, a charge generating substance, and a solvent, on the intermediate layer to form a charge generating layer (this step may be also referred to as a step of forming a charge generating layer); and (c) the step of coating a coating solution for a charge transfer layer, which contains a plurality of polycarbonate resins, a charge transfer agent, and a solvent, on the charge generating layer (this step may be also referred to as a step of forming a charge transfer layer).

Furthermore, the present invention can be applied on either the charge generating layer and the charge transfer layer. Preferably, it may be applied on the charge transfer layer, which can be provided on the uppermost surface of the photoconductor.

(7)-1 Step of Forming Intermediate layer

For the formation of an intermediate layer, a coating solution is prepared by dispersing and mixing a binding resin and optionally additives (such as organic fine powders or inorganic fine powders) together with an appropriate dispersion medium using a known technique, such as a roll mill, a ball mill, an attriter, a paint shaker, or a ultrasonic dispensing device to prepare a coating solution, applying the resultant coating solution on a conductive support by means of a known method, a blading method, a dipping method, or a spraying method, and subjecting a coated product to a thermal treatment, thereby forming an intermediate layer.

Furthermore, for the above additives, small amounts of different additives (organic or inorganic fine powders) may be preferably added for preventing the generation of interference fringes by causing light scattering, and so on, as far as the amounts of the additives do not participate in sedimentation or the like during the manufacturing process.

Subsequently, the resultant coating solution may be preferably coating on, for example, a supporting substrate (an untreated tube made of aluminum) by means of a coating method, such as a dip-coating method, a spray-coating method, a bead-coating method, a blade-coating method, a roller-coating method, or the like.

After that, it is desired to carry out a step of drying the coating solution on the supporting substrate at 20 to 200° C. for 5 minutes to 2 hours.

Furthermore, the solvent used for preparing such a coating solution may be any of various kinds of organic solvents, including alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ketones such as acetone, methylethylketone, and cyclohexanone; esters such as ethyl acetate and methyl acetate; dimethyl formaldehyde; dimethyl formamide; and dimethyl sulfoxide. These solvents may be used alone or in a combination of two or more of them.

(7)-2 Step of Forming Charge Generating Layer

Next, when the coating solution for a charge generating layer is prepared, a method for carrying out a dispersion treatment may be, but not specifically limited to, preferably a well-known method of roll mill, ball mill, vibratory ball mill, attriter, sand mill, colloid mill, paint shaker, or the like.

Subsequently, the resultant coating solution is applied on the surface of the previously-formed intermediate layer. The coating may be carried out by any of coating methods including a dip-coating method, a spray-coating method, a bead-coating method, a blade-coating method, and a roller-coating method.

After that, it is desired to carry out a step of drying the coating solution on the intermediate layer at 20 to 200° C. for 5 minutes to 2 hours.

In addition, the solvent in the above coating solution may be, as described above, a mixture solvent of propyleneglycol monoalkylether with a cyclic ether compound. In addition, for improving the dispersibility of the charge generating agent or the like and the smoothness of the surface of the photoconductor layer, a surfactant, a leveling agent, or the like may be added at the time of preparing the coating solution.

Furthermore, the amount of the solvent added in the coating solution may be preferably in the range of 1,000 to 50,000 parts by weight with respect to 100 parts by weight of the binding resin in the charge generating layer.

(7)-3 Step of Forming Charge Transfer Layer

Next, for the formation of a charge transfer layer, a charge transfer agent and so on may be preferably added to a solution in which a resin component is dissolved and then subjected to a dispersion treatment to form a coating solution.

Subsequently, the resultant coating solution is applied on the surface of the previously-formed charge generating layer. The coating may be carried out by any of coating methods including a dip-coating method, a spray-coating method, a bead-coating method, a blade-coating method, and a roller-coating method.

After that, it is desired to carry out a step of drying the coating solution on the intermediate layer at 20 to 200° C. for 5 minutes to 2 hours.

Furthermore, the solvent used for preparing such a coating solution may be any of various kinds of organic solvents, including alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ketones such as acetone, methylethylketone, and cyclohexanone; esters such as ethyl acetate and methyl acetate; dimethyl formaldehyde; dimethyl formamide; and dimethyl sulfoxide. These solvents may be used alone or in a combination of two or more of them. In addition, if required, a leveling agent or the like may be used.

Furthermore, the positive or negative charging type of the multilayer-type photoconductor is selected depending on the order of forming the charge generating layer and the charge transfer layer as described above and also depending on the type of the charge transfer agent used for preparing the charge transfer layer. For instance, as shown in FIG. 1, in the case that a charge generating layer 24 is formed on a substrate 12 and a charge transfer layer 22 is then formed thereon, a photoconductor is of a negative charge type when a charge transfer agent in the charge transfer layer 22 is a hole transfer agent made of an amine compound derivative or a stilbene derivative. In this case, the charge generating layer 24 may contain an electron transfer agent. Therefore, such a multilayer-type electrophotographic photoconductor has an extremely decreased residual potential, so that the sensitivity thereof can be improved.

Second Embodiment

Figure 5:
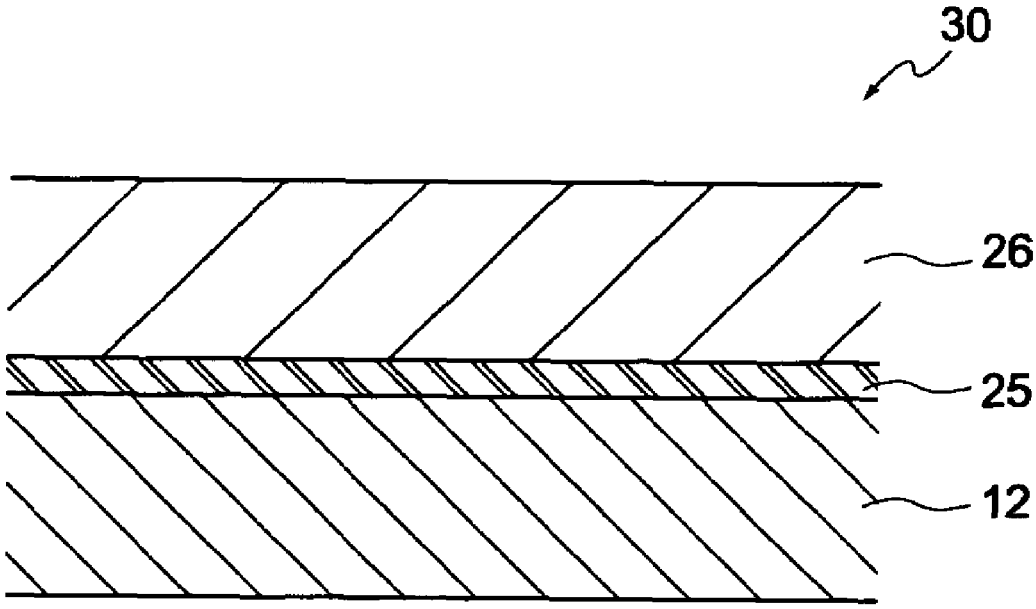
FIG. 5 is a schematic diagram for illustrating the configuration of a monolayer-type electrophotographic photoconductor.

As illustrated in FIG. 5, a second embodiment of the present invention is an electrophotographic photoconductor 30 having a monolayer-type photosensitive layer 26 containing at least a charge generating agent, a hole transfer agent and a binding resin and formed on a conductive substrate 12. The electrophotographic photoconductor 30 is characterized in that a plurality of polycarbonate resins is used as the binding resin and the photosensitive layer 26 contains a biphenyl derivative as a plasticizer component.

Hereinafter, the electrophotographic photoconductor as a monolayer-type photoconductor in accordance with the second embodiment of the present invention will be concretely described.

1. Basic Configuration

Regarding to the type and so on with respect to the basic configuration of the monolayer-type photoconductor, but not specifically limited to, the thickness of a photoconductor layer may be generally in the range of 5 to 100 μm, preferably in the range of 10 to 50 μm.

In addition, regarding to the types and so on of a plurality of polycarbonate resins having different average molecular weights and a plasticizer component, which constitute the monolayer-type photoconductor, but not specifically limited to, the amount of the plasticizer component added may be preferably in the range of 0.1 to 15 parts by weight with respect to 100 parts by weight of the binding resin.

Furthermore, as a conductive substrate on which such a photoconductor layer, any of various materials having electric conductivities can be employed. For example, the materials include iron, aluminum, cupper, tin, platinum, vanadium, molybdenum, chrome, cadmium, titanium, nickel, palladium, indium, stainless steel, and brass; plastic materials on which the above materials are deposited or laminated; and glass plates covered with aluminum, iodide, tin oxide, and indium oxide.

In addition, the conductive substrate may be of a sheet or drum shape or the like so as to fit to the structure of an image-forming apparatus used, as far as the substrate itself has its own conductivity or the surface of the substrate has conductivity. In addition, it is preferable that the conductive substrate may have a sufficient mechanical strength when it is used. In the case that the above photoconductor layer is formed by any of coating methods, a coating solution is prepared by dispersing and mixing the charge generating agent, the charge transfer agent, the binding resin, and so on as exemplified above with an appropriate dispersion medium using a known technique, such as a roll mill, a ball mill, an attriter, a paint shaker, or a ultrasonic dispensing device to prepare a coating solution, applying the resultant coating solution by means of a known method, and subjecting a coated product to a thermal treatment to dry, thereby forming a photoconductor layer.

Furthermore, regarding to the configuration of the monolayer-type photoconductor, a barrier layer may be formed between a conductive substrate and a photoconductor layer as far as it does not interfere the characteristics of the photoconductor. In addition, on the surface of the photoconductor, a protective layer may be formed.

2. Manufacturing Method

Furthermore, a method for manufacturing a monolayer-type photoconductor is not specifically limited. Preferably, however, a coating solution may be prepared at first. Then, the resultant coating solution is coated on the basis of the known manufacturing method. For instance, it is coated on a conductive substrate (an untreated tube made of aluminum) by a dip-coating method, and then dried by hot air at 100° C. for 30 minutes, thereby obtaining an electrophotographic photoconductor having a photosensitive layer of a predetermined thickness.

Furthermore, a solvent used for preparing a dispersion solution may be any of various organic solvents including alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethyl ether, diethyl ether, tetrahydrofuran, ethyleneglycol dimethylether, diethyleneglycol dimethylether, 1,3-dioxolan, and 1,4-dioxane; ketones such as acetone, methylethylketone, and cyclohexanone; esters such as ethyl acetate and methyl acetate; dimethyl formaldehyde; dimethyl formamide; and dimethyl sulfoxide. These solvents may be used alone or in a combination of two or more of them.

Furthermore, for improving the dispersibility of the charge generating agent or the like and the smoothness of the surface of the photoconductor layer, a surfactant, a leveling agent, or the like may be added at the time of preparing the coating solution.

EXAMPLES

Hereafter, the present invention will be concretely described with reference to examples thereof. However, the present invention is not restricted by the contents of their descriptions.

Example 1

1. Manufacture of Electrophotographic Photoconductor

On a conductive support, an intermediate layer, a charge generating layer, and a charge transfer layer were formed in that order, thereby a multilayer-type electrophotographic photoconductor of Example 1 was manufactured.

(1) Formation of Intermediate Layer

For forming an intermediate layer, 2.5 parts by weight of titanium oxide (subjected to a surface treatment with MT-02, alumina, silica, or silicon and having a number average primary particle size of 10 nm (manufactured by Tayca Co., Ltd.)), 1 part by weight of a quaternion co-polymerized polyamide resin CM8000 (manufactured by Toray Co., Ltd.), 10 parts by weight of methanol as a solvent, and 2.5 parts by weight of n-butanol were added and dispersed for 10 hours using a paint shaker, and then filtrated using a 5-μm filter, thereby a coating solution for an intermediate layer was formed.

Next, an aluminum substrate (supporting substrate) of 30 mm in diameter and 238.5 mm in length was coated by gradually immersing into the resultant coating solution for an intermediate layer at a rate of 5 mm/sec, while directing one end of the aluminum substrate upward. Subsequently, it was subjected to a thermal treatment at 130° C. for 30 min, thereby an intermediate layer of 2 μm in film thickness was formed.

(2) Preparation of Charge Generating Layer and Charge Transfer Layer (2)-1 Preparation of Coating Solution for Charge Generating Layer After adding 1 part by weight of titanyl phthalocyanine represented by the general formula (11), 1 part by weight of Resin KS-5 (manufactured by Sekisui Chemical Co., Ltd.) with an average molecular weight of 130,000 as a polyvinyl acetal resin, and as a mixed solvent, 60 parts by weight of propylene glycolmonomethyl ether, 20 parts by weight of tetrahydrofuran, then the mixture was stirred for 48 hours using a ball mill and then filtrated through a 3-μm filter, thereby a coating solution for a charge generating layer was obtained.

Furthermore, the titanyl phthalocyanine represented by the formula (11) and used in Example 1 was produced as follows: To a flask replaced with argon, 25 g of o-phthalonitrile, 28 g of titanium tetrabutoxide, and 300 g of quinoline were added and then heated up to 150° C. while stirring. Subsequently, steam generated from a reaction system is distilled off to the outside thereof, while heating up to 215° C. After that, while retaining the temperature, the reaction was carried out by stirring for 2 hours.

After terminating the reaction, a reaction mixture was removed from the flask when it was cooled to 150° C. and then filtrated through a glass filter. The resultant solid was washed with N,N-dimethylformamide and methanol in this order and then dried under vacuum, thereby 24 g of a blue-violet solid (pretreatment prior to pigment preparation) was obtained.

To 100 ml of N,N-dimethyl formamide, 10 g of the blue-violet solid obtained by the synthesis of the above titanyl phthalocyanine compound was added and then heated at 130° C. for 2 hours while stirring to carry out a stirring treatment.

Subsequently, the heating was stopped after 2 hours passed and also the stirring was stopped when it was cooled to 23±1° C. The resultant solution was left standing for 12 hours under such conditions to carry out stabilization.

Then, the stabilized solution was filtrated though a glass filter, and the resultant solid was then washed with methanol, followed by a vacuum drying. Consequently, 9.83 g of crude crystal of the titanyl phthalocyanine compound was obtained.

Next, 5 g of a crude crystal of titanyl phthalocyanine obtained by the pretreatment prior to pigment preparation was dissolved by the addition of 100 ml of concentrated sulfuric acid.

Subsequently, the solution was dropped into water under ice-cooling and then stirred at room temperature for 15 minutes. The solution was left standing at 23±1° C. for 30 minutes to carry out recrystallization.

After that, the above solution was filtrated through a glass filter, and the resultant solid was washed with water until the washing solution would become neutral. In a state of remaining water without drying, the solid was dispersed in 200 ml of chlorobenzene and then heated at 50° C. for 10 hours, while stirring.

Furthermore, the solution was filtrated through a glass filter and the resultant solid was then heated at 50° C. for 5 hours, followed by vacuum drying. Consequently, 4.1 g of a crystal of titanyl phthalocyanine (blue powder) was obtained.

The titanyl phthalocyanine was confirmed that there was no peak generated at a Bragg angle of $2\theta \pm 0.2° = 7.4°$ and 26.2° in the initial stages and even after immersing in 1,3-dioxysolan or tetrahydrofuran for 7 days. In addition, it was confirmed that there was no peak of temperature variation from 50 to 400° C. except for a peak at about 90° C. due to the evaporation of absorbed water.

(2)-2 Preparation of Coating Solution for Charge Transfer Layer

In addition, using 460 parts by weight of tetrahydrofuran, 70 parts by weight of a stilbene compound (HTM-1) represented by the formula (21) as a hole transfer agent, 20 parts by weight of tarphenyl represented by the formula (3), as a binding resin, 30 parts by weight of a polycarbonate resin represented by the formula (25) (Resin-1) with an average molecular weight of 50,500, and 70 parts by weight of a bisphenol Z type polycarbonate resin represented by the formula (28) (Resin-4) with an average molecular weight of 50,200 were homogeneously dissolved, thereby a coating solution for a charge transfer layer was obtained.

(2)-3 Preparation of Charge Generating Layer and Charge Transfer Layer

On the intermediate layer formed on the supporting substrate, a coating solution for a charge generating layer was applied using a blade made of a fluorine resin, followed by drying at 80° C. for 5 minutes. Consequently, a charge generating layer of 0.3 μm in film thickness was formed.

Subsequently, the coating solution for the charge transfer layer prepared was applied on the charge generating layer by the same way as that of the coating solution for the charge generating layer, followed by drying at 130° C. for 30 minutes. Consequently, a charge transfer layer of 20 μm in film thickness was formed.

2. Evaluation of Electrophotographic Photoconductor

The electrophotographic photoconductor thus prepared was evaluated with respect to electric properties and wear volume thereof by mounting the photoconductor on a commercially-available printer (laser printer, Microline-18, manufactured by Oki Electric Industry Co., Ltd.), which employs the process for negatively charged reversal development.

(1) Charged Potential (Vo)

The electrophotographic photoconductor obtained was mounted on a printer and the charged potential (Vo) at this time was then measured. The results are shown in Table 1.

(2) Sensitivity (VL)

The electrophotographic photoconductor obtained was mounted on a printer and then charged to −850 (V). A potential at the development position when a black solid image was obtained was read out and the absolute value obtained was provided as a light potential (V) as sensitivity. The results obtained are shown in Table 1.

(3) Wear Volume

The wear volume of the electrophotographic photoconductor obtained was measured. That is, the difference of film thicknesses before and after continuously printing of 10,000 sheets of A4 paper. The film thickness of the photosensitive layer was measured using an eddy-current film thickness meter.

(4) Test for Finger Oil Adhesion (48 Hrs and 96 Hrs)

For the electrophotographic photoconductor obtained, a test for finger oil adhesion was carried out. That is, the finger was brought into press contact with the surface of the photosensitive layer and the surface of a photosensitive layer was then checked with eyes after storing for 48 hours and 96 hours under the environment of 23° C. and 50% RH.

++ (excellent): No crack generation;

+ (good): clack generated at not more than one position, which can be observed using a microscopy, ± (acceptable): clack generation occurred at not more than five positions, which can be observed by eyes, and − (poor): clack generation occurred at six or more positions, which can be observed by eyes.

(5) Evaluation of Optical Response

The optical response of the multilayer-type electrophotographic photoconductor obtained was evaluated. That is, when the photoconductor was charged at −700 V using a drum-type sensitivity testing device (manufactured by GEN-TEC Co., Ltd.), the amount of light was temporarily defined under the conditions that a surface potential would become 100 V after 300 msec from the initiation of light irradiation from a xenon flash tube (pulse width: 50 nm, light of 780 nm in wavelength was irradiated using filter) to the photoconductor. Then, when light was irradiated on the photoconductor at an optical mount defined under such defining conditions, a time period required until the surface potential would become 130 V (95% response) was measured as optical response.

Here, when the optical response was within 20 msec, it was revealed that no practical disadvantage was observed with respect to sensitivity. In addition, when the optical wavelength was within 10 msec, the photoconductor could be determined to have an excellent sensitivity.

Example 2 to 5

In Examples 2 to 5, as shown in Table 1, electrophotographic photoconductors were prepared and evaluated by the same way as that of Example 1, except that the amounts of the plasticizer added in these examples were changed to 5, 10, 15, and 25 parts by weight with respect to 100 parts of the binding resin, respectively. The results thus obtained are shown in Table 1.

Example 6 to 9

In Examples 6 to 9, as shown in Table 1, electrophotographic photoconductors were prepared and evaluated by the same way as that of Example 1, except that the types of plasticizes were changed such that biphenyl derivatives (BP-1, and BP-3 to BP-5) represented by the formulae (2), and (4) to (6) were used, respectively. The results thus obtained are shown in Table 1.

Example 10 to 15

In Examples 10 to 15, as shown in Table 1, electrophotographic photoconductors were prepared and evaluated by the same way as that of Example 1, except that the types of binding resins (combinations) were changed as follows. The results thus obtained are shown in Table 1.

Example 10: The binding resin used was a combination of 30 parts by weight of a polycarbonate resin (Resin-2) represented by the formula (26) and 70 parts by weight of a polycarbonate resin (Resin-4) represented by the formula (28).

Example 11: The binding resin used was a combination of 30 parts by weight of a polycarbonate resin (Resin-3) represented by the formula (27) and 70 parts by weight of a polycarbonate resin (Resin-4) represented by the formula (28).

Example 12: The binding resin used was a combination of 30 parts by weight of a polycarbonate resin (Resin-1) represented by the formula (25) and 70 parts by weight of a polycarbonate resin (Resin-5) represented by the formula (29).

Example 13: The binding resin used was a combination of 30 parts by weight of a polycarbonate resin (Resin-2) represented by the formula (26) and 70 parts by weight of a polycarbonate resin (Resin-5) represented by the formula (29).

Example 14: The binding resin used was a combination of 30 parts by weight of a polycarbonate resin (Resin-3) represented by the formula (27) and 70 parts by weight of a polycarbonate resin (Resin-5) represented by the formula (29).

Example 15: The binding resin used was a combination of 30 parts by weight of a polycarbonate resin (Resin-1) represented by the formula (25) and 70 parts by weight of a polycarbonate resin (Resin-6) represented by the formula (30).

Examples 16 to 18

In Examples 16 to 18, as shown in Table 1, electrophotographic photoconductors were prepared and evaluated by the same way as that of Example 1, except that the types of hole transfer agents were changed to compounds (HTM-2 to 4) represented by the formulae (22) to (24), respectively. The results thus obtained are shown in Table 1.

Comparative Examples 1 to 4

In Comparative Examples 1 to 4, as shown in Table 1, electrophotographic photoconductors were prepared and evaluated by the same way as that of Example 1, except that the types of hole transfer agents were changed to compounds (HTM-1 to 4) represented by the formulae (21) to (28), respectively, while no plasticizer was added. The results thus obtained are shown in Table 1.

Comparative Example 5

In Comparative Example 5, as shown in Table 1, an electrophotographic photoconductor was prepared and evaluated by the same way as that of Example 1, except that the hole transfer agent was changed to a compound (HTM-5) represented by the formula (33) below. The results thus obtained are shown in Table 1.

(33)

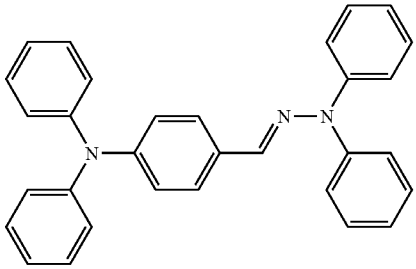

(HTM-5)

Comparative Example 6

In Comparative Example 6, as shown in Table 1, an electrophotographic photoconductor was prepared and evaluated by the same way as that of Example 1, except that the hole transfer agent was changed to a compound (HTM-6) represented by the formula (34) below. The results thus obtained are shown in Table 1.

(34)

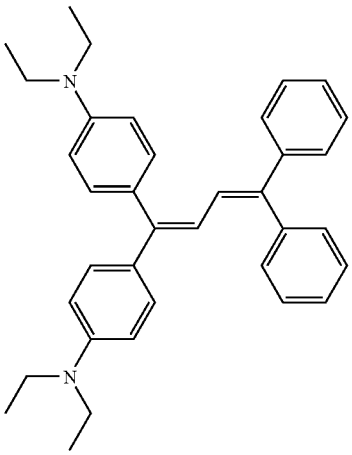

(HTM-6)

Comparative Example 7

In Comparative Example 7, as shown in Table 1, an electrophotographic photoconductor were prepared and evaluated by the same way as that of Example 1, except that the binding resin used was 100 parts by weight of a polycarbonate resin (Resin-1) represented by the general formula (25), while no plasticizer was added. The results thus obtained are shown in Table 1.

Comparative Example 8

In Comparative Example 8, as shown in Table 1, an electrophotographic photoconductor were prepared and evaluated by the same way as that of Example 1, except that the binding resin used was 100 parts by weight of a polycarbonate resin (Resin-1) represented by the general formula (25). The results thus obtained are shown in Table 1.

Furthermore, the average molecular weights of the polycarbonate resins used in Examples 2 to 18 and Comparative Examples 1 to 8 were 49,700 (Resin-2), 48,800 (Resin-3), 50,200 (Resin-4), 51,000 (Resin-5), and 48,500 (Resin-6), respectively.

TABLE 1

| | Binding resin | | Hole transfer | Plasticizer component | | Evaluation results | | | | | |
|---|---|---|---|---|---|---|---|---|---|---|---|
| | | | | | | | | | Finger oil adhesion test | | |
| | Type | Ratio | agent | Type | Amount added (Parts by weight) | Charge (V) | Sensitivity (V) | Wear volume (¼) m | 48 h | 96 h | Optical response (msec) |
| Exp. 1 | Resin-1/Resin-4 | 30/70 | HTM-1 | BP-2 | 20 | 880 | 35 | 1.25 | ++ | ++ | 4.5 |
| Exp. 2 | | | | | 5 | 881 | 33 | 1.19 | ++ | ++ | 4.4 |
| Exp. 3 | | | | | 10 | 880 | 36 | 1.23 | ++ | ++ | 4.5 |
| Exp. 4 | | | | | 15 | 875 | 35 | 1.25 | ++ | ++ | 4.5 |
| Exp. 5 | | | | | 25 | 883 | 40 | 1.37 | ++ | ++ | 4.7 |
| Exp. 6 | | | | BP-1 | 20 | 879 | 38 | 1.24 | ++ | ++ | 6.2 |
| Exp. 7 | | | | BP-3 | | 858 | 35 | 1.19 | ++ | ++ | 5.1 |
| Exp. 8 | | | | BP-4 | | 859 | 33 | 1.3 | ++ | ++ | 4.8 |
| Exp. 9 | | | | BP-5 | | 854 | 34 | 1.15 | ++ | ++ | 4.9 |
| Exp. 10 | Resin-2/Resin-4 | | | BP-2 | | 856 | 35 | 1.25 | ++ | ++ | 4.4 |
| Exp. 11 | Resin-3/Resin-4 | | | | | 887 | 33 | 1.22 | ++ | ++ | 4.5 |
| Exp. 12 | Resin-1/Resin-5 | | | | | 859 | 36 | 1.24 | ++ | ++ | 4.7 |
| Exp. 13 | Resin-2/Resin-5 | | | | | 860 | 26 | 1.19 | ++ | ++ | 4.5 |
| Exp. 14 | Resin-3/Resin-5 | | | | | 864 | 34 | 1.25 | ++ | ++ | 4.4 |
| Exp. 15 | Resin-1/Resin-6 | | | | | 864 | 34 | 1.01 | ++ | ++ | 4.5 |
| Exp. 16 | Resin-1/Resin-4 | | HTM-2 | | | 844 | 28 | 1.17 | ++ | ++ | 4.1 |
| Exp. 17 | | | HTM-3 | | | 865 | 33 | 1.12 | ++ | ++ | 7.0 |
| Exp. 18 | | | HTM-4 | | | 854 | 29 | 1.21 | ++ | ++ | 4.1 |
| Comp. 1 | | | HTM-1 | — | — | 875 | 32 | 1.18 | ++ | ± | 4.5 |
| Comp. 2 | | | HTM-2 | | | 847 | 26 | 1.05 | ++ | ± | 4.0 |
| Comp. 3 | | | HTM-3 | | | 865 | 33 | 1.12 | ++ | ± | 7.0 |
| Comp. 4 | | | HTM-4 | | | 854 | 29 | 1.21 | ++ | ± | 4.2 |
| Comp. 5 | | | HTM-5 | | | 859 | 57 | 1.29 | + | − | 20.0 |
| Comp. 6 | | | HTM-6 | | | 850 | 50 | 1.27 | + | − | 38.0 |
| Comp. 7 | Resin-1 | 100 | HTM-1 | | | 855 | 45 | 1.67 | ++ | ± | 4.5 |
| Comp. 8 | | | | BP-2 | 20 | 850 | 40 | 1.79 | ++ | ++ | 4.5 |

Example 19

1. Production of Titanyl Phthalocyanine Crystal (2) Production of Titanyl Phthalocyanine Compound To a flask replaced with argon, 22 g of o-phthalonitrile (0.17 mol), 25 g of titanium tetrabutoxide (0.073 mol), 300 g of quinoline, and 2.28 g of urea (0.038 mol) were added and then heated up to 150° C. while stirring.

Subsequently, steam generated from a reaction system is distilled off to the outside thereof, while heating up to 215° C. After that, while retaining the temperature, the reaction was carried out by stirring for 2 hours.

Subsequently, after terminating the reaction, a reaction mixture was removed from the flask when it was cooled to 150° C. and then filtrated through a glass filter. The resultant solid was washed with N,N-dimethylformamide and methanol in this order and then dried under vacuum, thereby 24 g of a blue-violet solid was obtained.

(2) Pretreatment Prior to Pigment Preparation

To 100 ml of N,N-dimethyl formamide, 10 g of the blue-violet solid obtained by the production of the titanyl phthalocyanine compound described above was added and then heated at 130° C. for 2 hours while stirring to carry out a stirring treatment.

Subsequently, the heating was stopped when 2 hours passed and also the stirring was stopped when it was cooled to 23±1° C. The resultant solution was left standing for 12 hours under such conditions to carry out stabilization. Then, a supernatant after the stabilization was filtrated through a glass filter, and the resultant solid was then washed with methanol, followed by a vacuum drying. Consequently, 9.83 g of crude crystal of the titanyl phthalocyanine compound was obtained.

(3) Pigment Preparation 5 g of the crude crystal of titanyl phthalocyanine obtained by the pretreatment prior to pigment preparation was dissolved by the addition of 100 ml of concentrated sulfuric acid.

Subsequently, the solution was dropped into water under ice-cooling and then stirred at room temperature for 15 minutes. The solution was left standing at 23±1° C. for 30 minutes to carry out recrystallization, followed by separating from a supernatant.

After that, the resultant solid was filtrated through a glass filter, and washed with water until the washing solution would become neutral. In a state of remaining water without drying, the solid was dispersed in 200 ml of chlorobenzene and then heated at 50° C. for 10 hours, while stirring. Furthermore, the solution was filtrated through a glass filter and the resultant solid was then heated at 50° C. for 5 hours, followed by vacuum drying. Consequently, 4.1 g of an unsubstituted titanyl phthalocyanine crystal (blue powder) represented by the formula (7) was obtained. Hereinafter, by the way, the resultant titanyl phthalocyanine crystal will be referred to as TiOPc-A.

Figure 6:
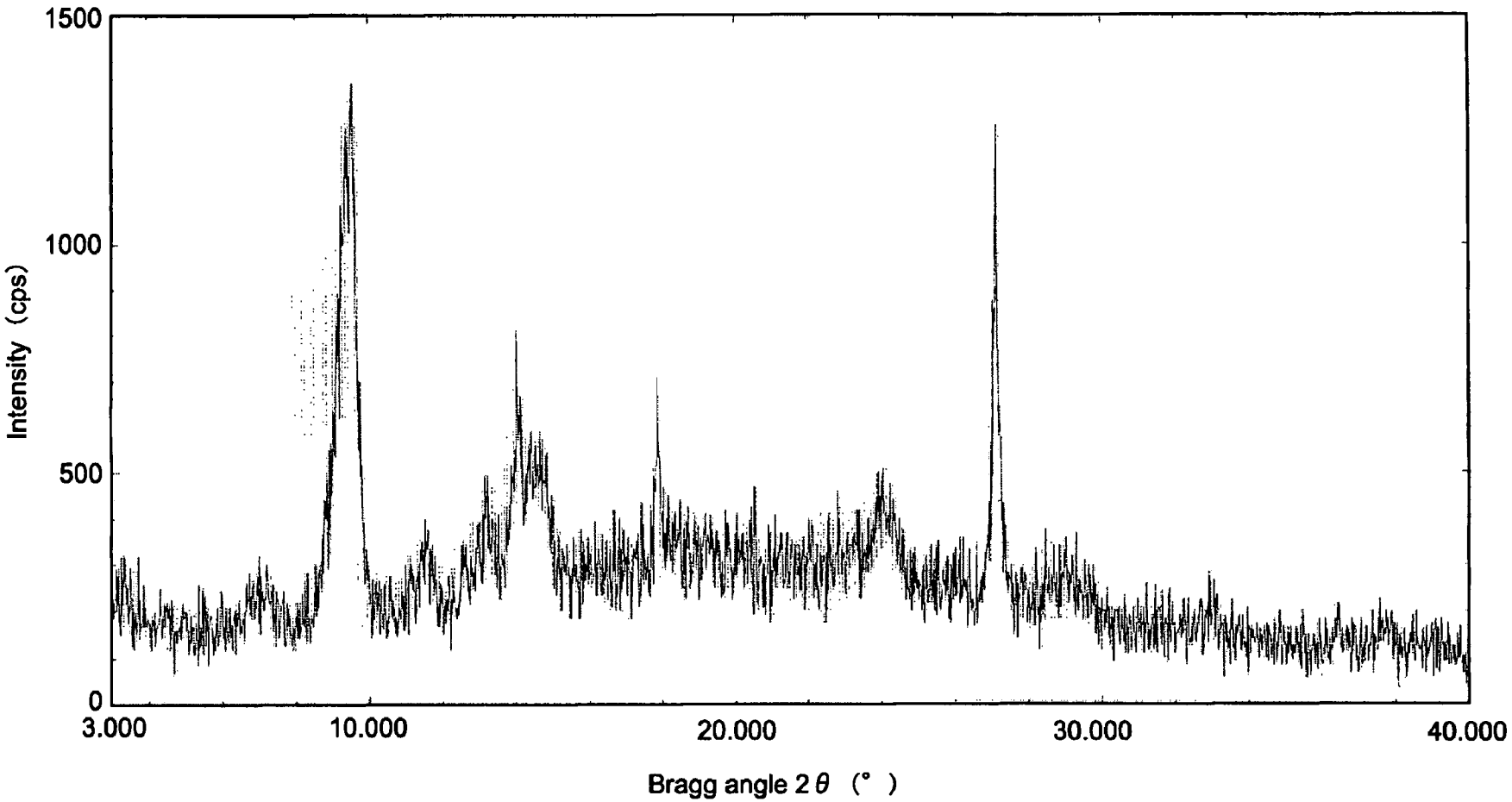
FIG. 6 is a X-ray diffraction spectrum of TiOPc-A.
Figure 7:
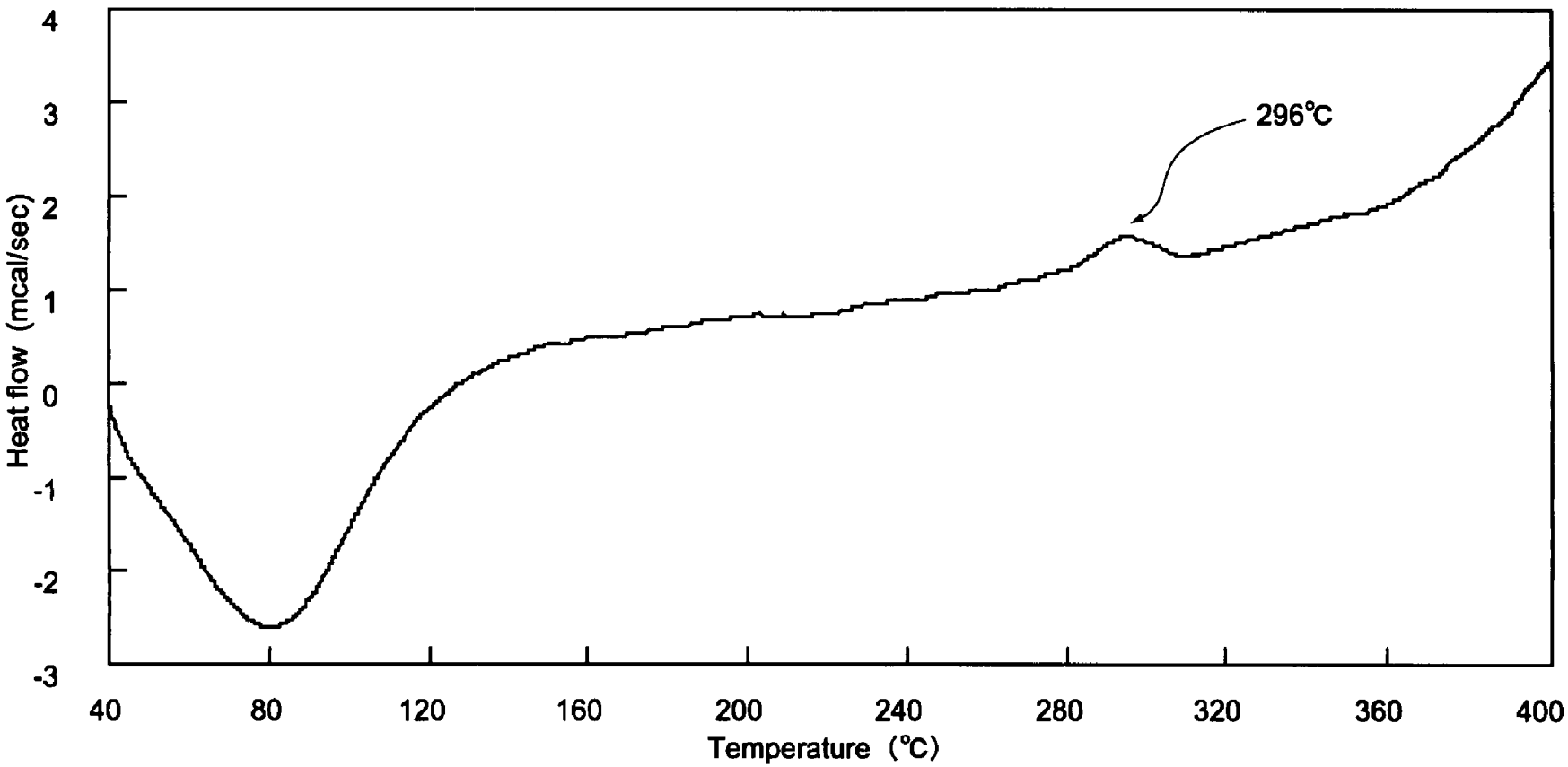
FIG. 7 is a differential scanning calorimeter spectrum of TiOPc-A.

2. Evaluation of Titanyl Phthalocyanine Crystal (1) Measurement of CuKα Characteristic X-ray Diffraction Spectrum 0.3 g of the resultant titanyl phthalocyanine crystal within 60 minutes after the production was dispersed in 5 g of tetrahydrofuran and then stored for 7 days in a closed system under conditions of a temperature of 23±1° C. and a relative humidity of 50 to 60%. After the storage, tetrahydrofuran was removed from the mixture and then filled in a sample holder of a X-ray diffraction apparatus (RINT1100, manufactured by Rigaku Corporation), followed by measurement. The resultant spectrum chart is shown in FIG. 6.

The conditions of the measurement were as follows:

X-ray tube: Cu

Tube voltage: 40 kV

Tube current: 30 mA

Start angle: 3.0°

Stop angle: 40.0°

Scanning Rate: 10°/min.

The results of the measurement thus obtained were evaluated on the basis of the following criteria. The results thus obtained are shown in Table 2.

+ (acceptable): Maximum peak was observed at a Bragg angle of 2θ±0.2°=27.2° but no peak was observed at 26.2°.

− (unacceptable): Peak was observed at a Bragg angle of 2θ±0.2°=26.2°.

(2) Differential Thermal Analysis

The resultant titanyl phthalocyanine crystal was subjected to a differential thermal analysis using a differential scanning calorimeter (Type: TAS-200, DSC8230D, manufactured by Rigaku Corporation). The resultant charts from the differential thermal analysis are shown in Table 7, respectively. In addition, peak temperatures and the numbers at peaks are shown in Table 2, respectively.

Furthermore, the measurement conditions were as follows:

Sample pan: aluminum

Rate of temperature increase: 20° C./min.

3. Production of Electrophotographic Photoconductor

Next, electrophotographic photoconductors were prepared by the same way as that of Example 1, except for the follows: As a charge generating agent to be included in the charge generating layer, the titanyl phthalocyanine crystal obtained by the above production method was used. In addition, two types of electrophotographic photoconductors, one prepared using a coating solution for a charge generating layer directly after the production and the other prepared using a coating solution for a charge generating layer after storing 7 days from the production.

4. Evaluation of Electrophotographic Photoconductor (1) Variations in Sensitivity (VL)

A light potential VL1 (v) of a photoconductor prepared using a coating solution for a charge generating layer directly after the production and a light potential VL2 (V) prepared using a coating solution for a charge generating layer after storing 7 days from the production were subjected to the measurement under following conditions, respectively.

That is, each of the electrophotographic photoconductors produced was mounted on a commercially-available printer (Laser printer, Microline-18, manufactured by Oki Electric Industry Co., Ltd.), which employs the process for negatively charged reversal development, and then charged to −850 (V). Subsequently, potentials at development positions when black solid images were formed were read out and then defined as VL1 (V) and VL2 (V), respectively.

After that, the amount of variations in sensitivity ΔVL (V) (=VL2−VL1) was calculated. The results obtained are shown in Table 3.

(2) Evaluation of Fogged Image

A printer such as Microline 22N (manufactured by Kyoceramita Corporation), on which an electrophotographic photoconductor formed using a coating solution for a charge generating layer after storing 7 days from the production was mounted, was employed to carry out an image formation at high temperature and high humidity (temperature: 35° C., humidity 85% Rh), thereby continuously printing 200,000 sheets of image pattern of 5% concentration on the basis of the ISO standard, while intermittently printing 50,000 sheets of image pattern of 2% concentration on the basis of the ISO standard.

Subsequently, a spectral photometer SPECTROEYE (manufactured by GretagMacbeth, Co., Ltd.) was used to determine the image density of non-printing areas at the time of continuously printing 200,000 sheets of image pattern of 5% image density on the basis of the ISO standard, while intermittently printing 50,000 sheets of image pattern of 2% image density on the basis of the ISO standard, respectively. The fogged images were evaluated on the basis of the following criteria. The results thus obtained are shown in Table 3.

+ (Good): The image density of a non-printing area was less than 0.008, and fogging defect cannot be observed at all.

± (Acceptable): The image density of a non-printing area was 0.008 or more but less than 0.015, and fogging defects can be observed a little.

− (Poor): The image density of a non-printing area was 0.15 or more, and significant fogging defects can be observed.

(3) Finger Oil Adhesion Test (48 Hrs, 96 Hrs)

The finger oil adhesion tests after 48 hrs and 96 hrs were carried out on the resultant electrophotographic photoconductors by the same way as that of Example 1, respectively. The results thus obtained are shown in Table 3.

Examples 20 to 23

In Examples 20 to 23, as shown in Table 3, the electrophotographic photoconductors were prepared and evaluated by the same way as that of Example 19, except that the amounts of the plasticizer added were changed to 5, 10, 15, and 25 parts by weight with respect to 100 parts by weight of the binding resin, respectively. The results thus obtained are shown in Table 3.

Examples 24 to 28

In Examples 24 to 28, the electrophotographic photoconductors were prepared and evaluated by the same ways as those of Examples 19 to 23, except that titanyl phthalocyanine crystals (TiOPc-B) prepared by the following method were used as charge generating agents, respectively. The results thus obtained are shown in Table 3.

That is, in the production of TiOPc-B, a titanyl phthalocyanine crystal was prepared by the same way as that of TiOPc-A, except that the amount of urea added when a titanyl phthalocyanine is prepared was 5.70 g (0.095 mol). Consequently, 4.1 g of unsubstituted titanyl phthalocyanine crystal (blue powder) was obtained.

Furthermore, the optical characteristics and thermal characteristics of the resultant titanyl phthalocyanine crystal are shown in Table 2.

Figure 8:
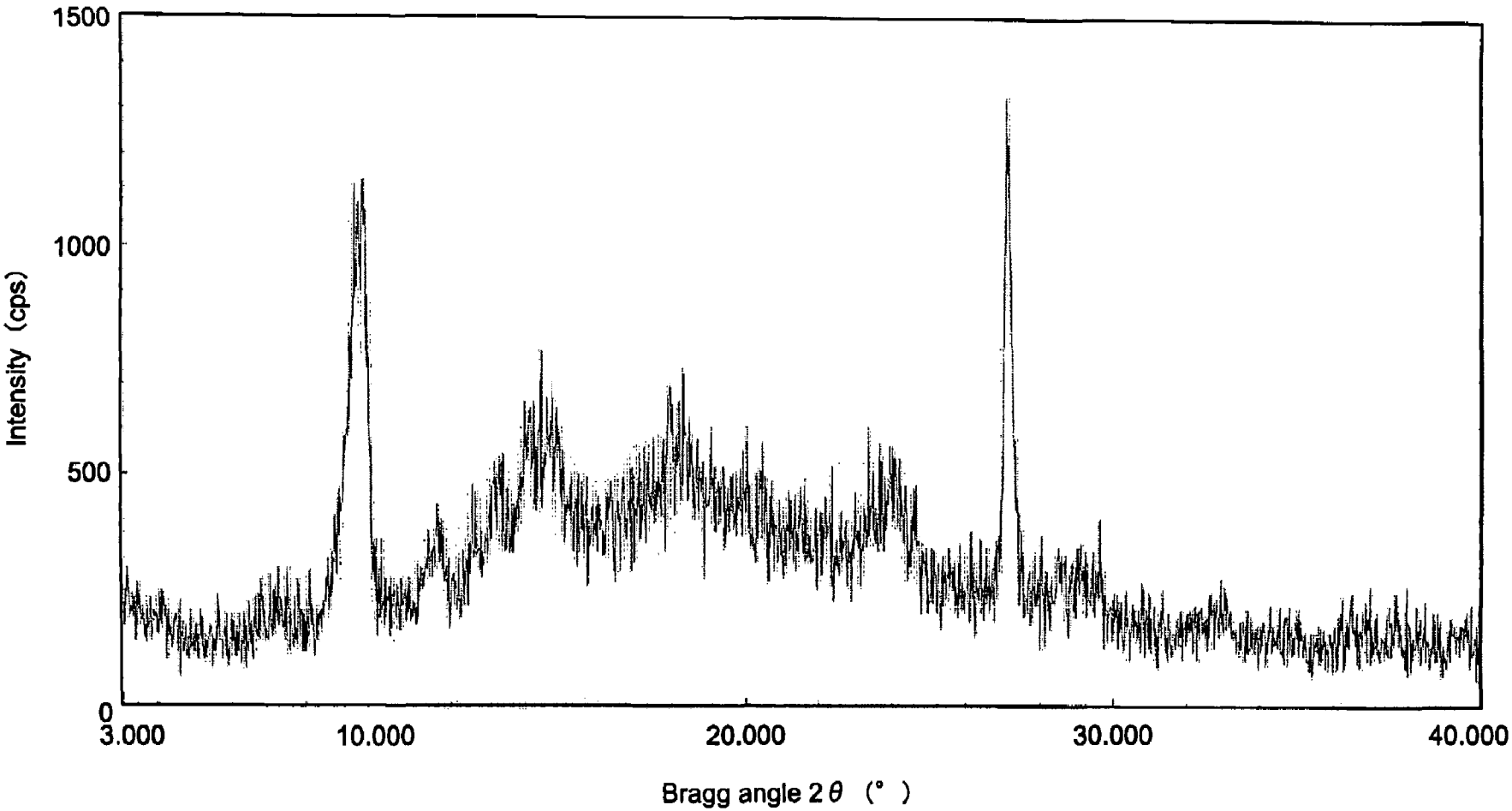
FIG. 8 is a X-ray diffraction spectrum of TiOPc-B.
Figure 9:
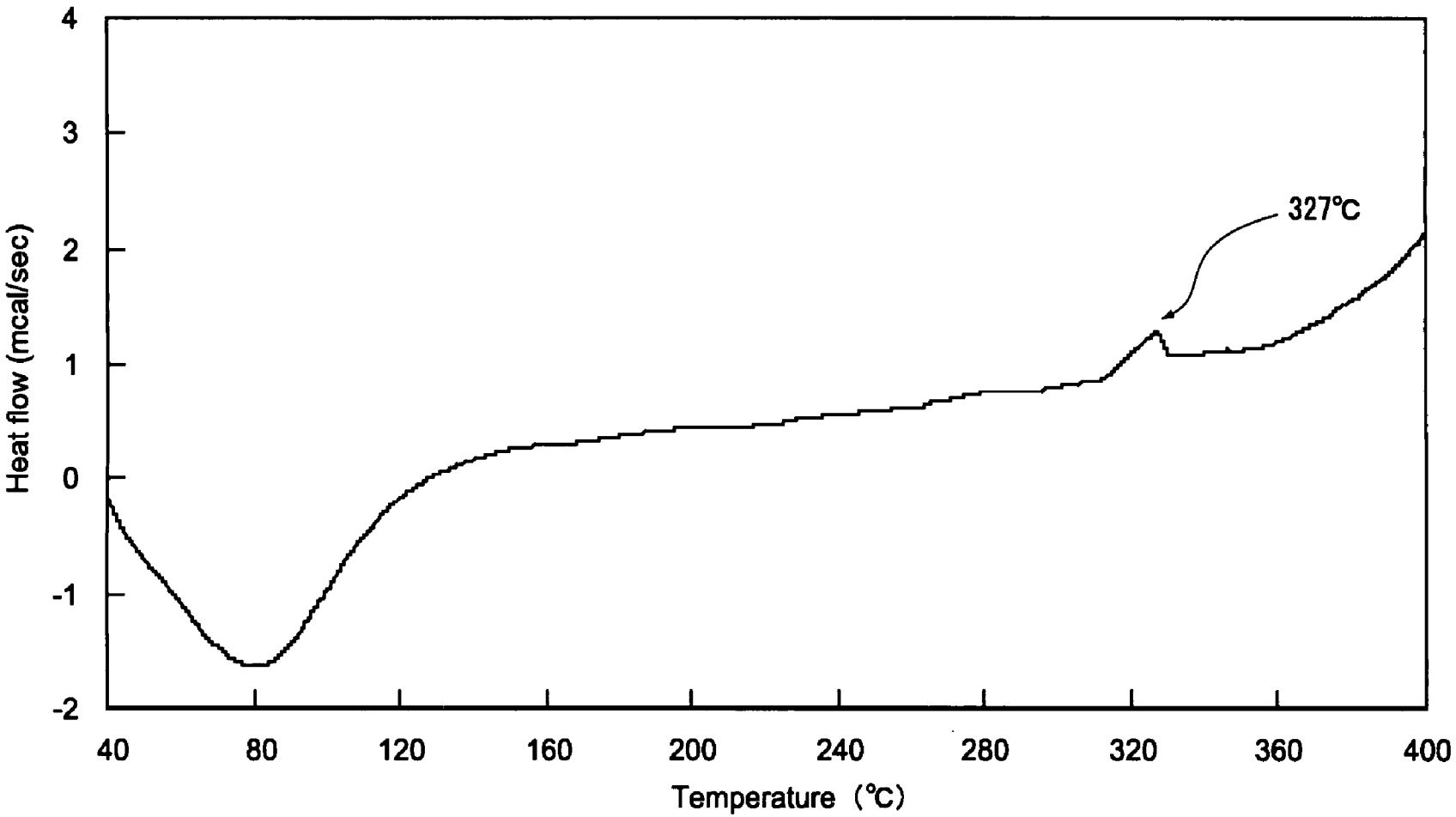
FIG. 9 is a differential scanning calorimeter spectrum of TiOPc-B.

In addition, an X-ray diffraction spectrum chart of the titanyl phthalocyanine crystal was shown in FIG. 8, while a differential thermal analysis chart was shown in FIG. 9, respectively.

Examples 29 to 33

In Examples 29 to 33, the electrophotographic photoconductors were prepared and evaluated by the same ways as those of Examples 19 to 23, except that titanyl phthalocyanine crystals (TiOPc-C) prepared by the following method were used as charge generating agents, respectively. The results thus obtained are shown in Table 3.

That is, in the production of TiOPc-C, a titanyl phthalocyanine crystal was prepared by the same way as that of TiOPc-A, except that the amount of urea added when a titanyl phthalocyanine is prepared was 8.40 g (0.014 mol). Consequently, 4.1 g of unsubstituted titanyl phthalocyanine crystal (blue powder) was obtained.

Furthermore, the optical characteristics and thermal characteristics of the resultant titanyl phthalocyanine crystal are shown in Table 2.

Figure 10:
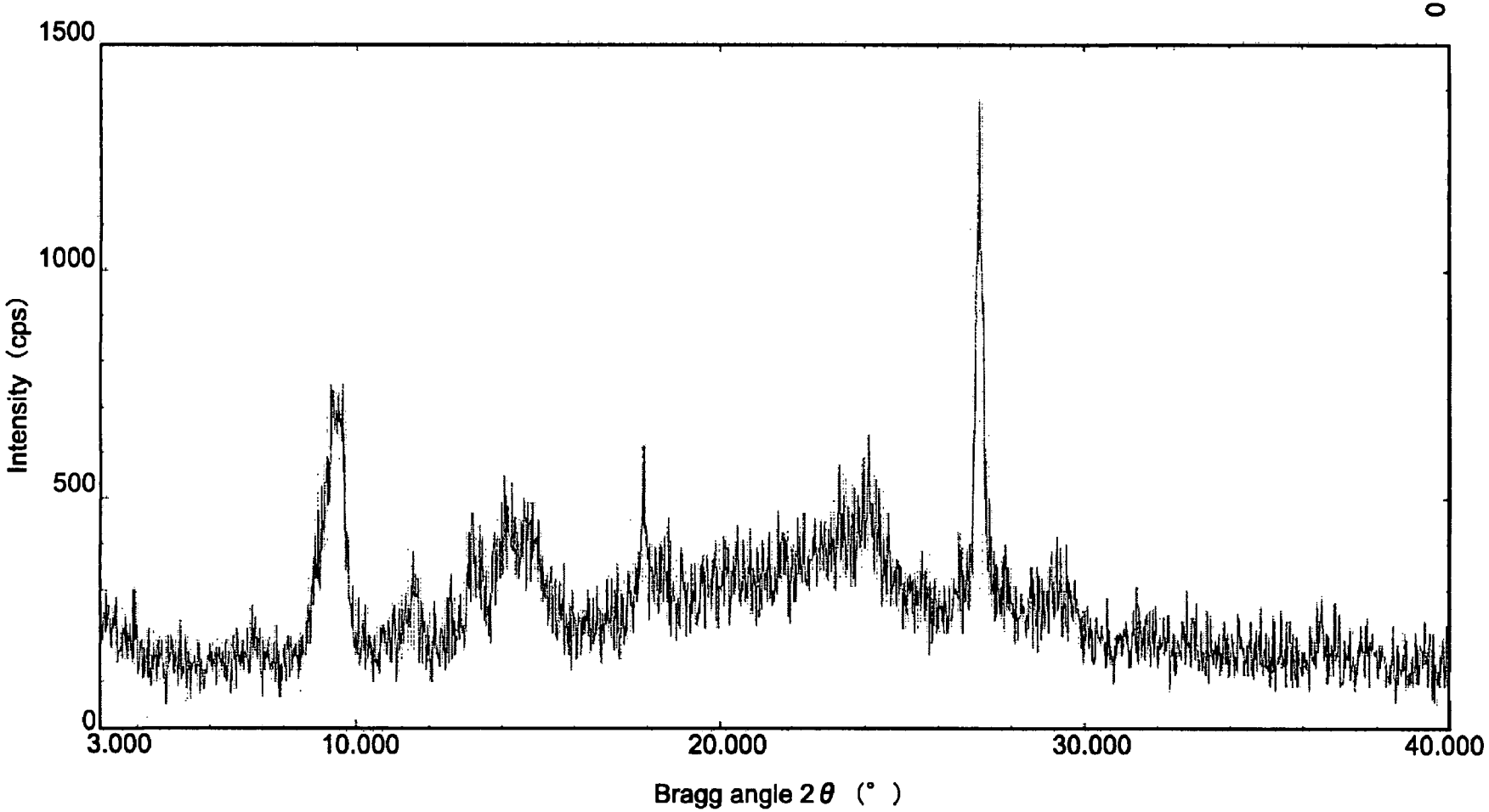
FIG. 10 is a X-ray diffraction spectrum of TiOPc-C.
Figure 11:
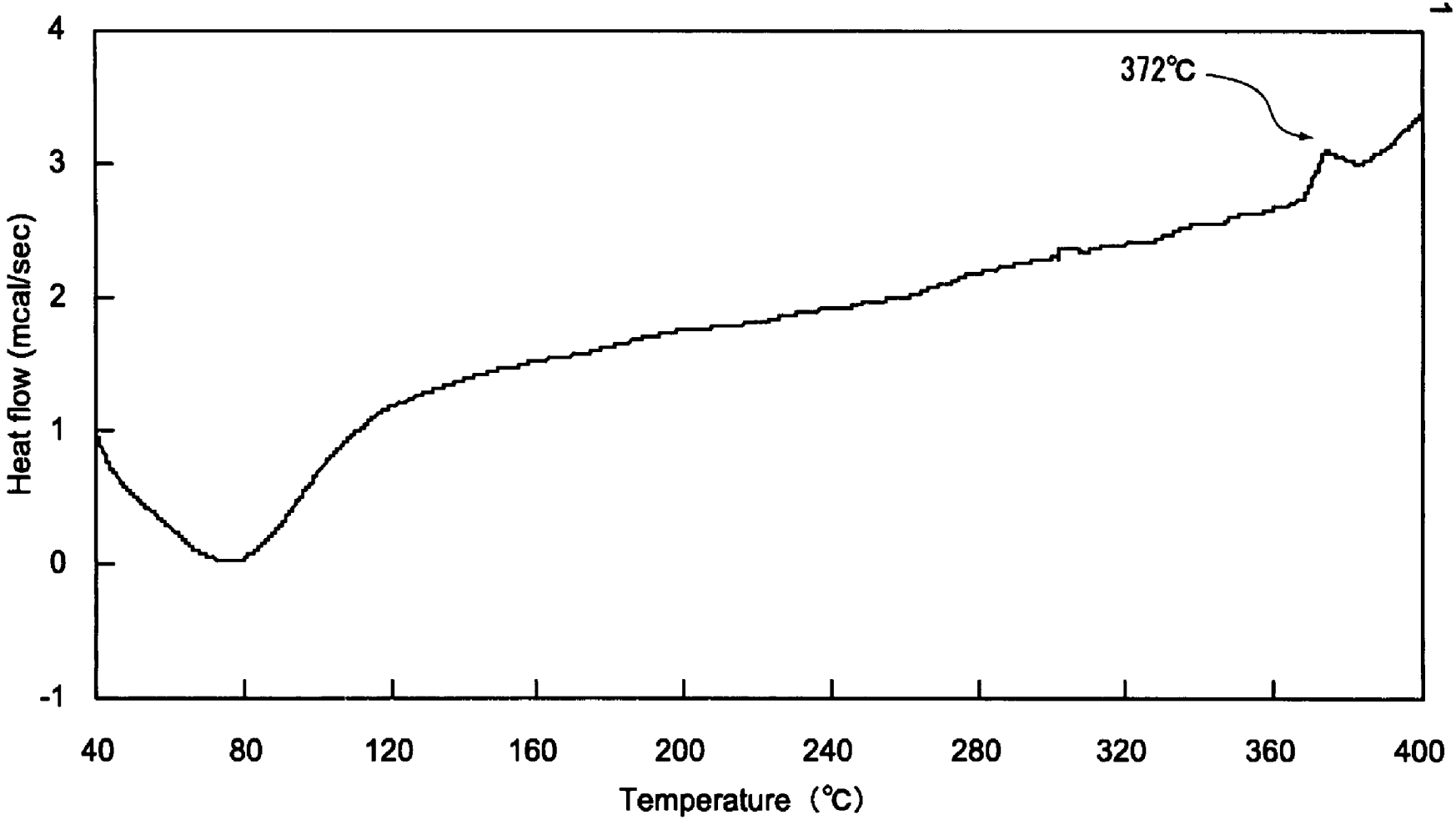
FIG. 11 is a differential scanning calorimeter spectrum of TiOPc-C.

In addition, an X-ray diffraction spectrum chart of the titanyl phthalocyanine crystal was shown in FIG. 10, while a differential thermal analysis chart was shown in FIG. 11, respectively.

TABLE 2

| | Titanium tetrabutoxide(mol)/ o-phthalonitrile(mol) | Urea(mol)/ o-phthalonitrile(mol) | Peak in DSC Temperature (° C.) | Peak in DSC Number of pieces (Number) | Evaluation of X-ray diffraction spectrum |
|---|---|---|---|---|---|
| TiOPc-A | 0.43 | 0.22 | 296 | 1 | + |
| TiOPc-B | 0.43 | 0.56 | 327 | 1 | + |
| TiOPc-C | 0.43 | 0.82 | 372 | 1 | + |

TABLE 3

| | Binding resin Type | Binding resin Ratio | Charge generating agent | Hole transfer agent | Plasticizer component Type | Plasticizer component Amount added (pbw) | Evaluation results Sensitivity Change (V) | Finger oil adhesion test 48 h | Finger oil adhesion test 96 h | Fogging |
|---|---|---|---|---|---|---|---|---|---|---|
| Exp. 19 | Resin-1/Resin-4 | 30/70 | TiOPc-A | HTM-1 | BP-2 | 20 | 2 | ++ | ++ | + |
| Exp. 20 | | | | | | 5 | 2 | ++ | ++ | + |
| Exp. 21 | | | | | | 10 | 2 | ++ | ++ | + |
| Exp. 22 | | | | | | 15 | −1 | ++ | ++ | + |
| Exp. 23 | | | | | | 25 | 4 | ++ | ++ | + |
| Exp. 24 | | | TiOPc-B | | | 20 | 2 | ++ | ++ | + |
| Exp. 25 | | | | | | 5 | 1 | ++ | ++ | + |
| Exp. 26 | | | | | | 10 | 3 | ++ | ++ | + |
| Exp. 27 | | | | | | 15 | −2 | ++ | ++ | + |
| Exp. 28 | | | | | | 25 | 5 | ++ | ++ | + |
| Exp. 29 | | | TiOPc-C | | | 20 | 3 | ++ | ++ | + |
| Exp. 30 | | | | | | 5 | 2 | ++ | ++ | + |
| Exp. 31 | | | | | | 10 | 2 | ++ | ++ | + |
| Exp. 32 | | | | | | 15 | 1 | ++ | ++ | + |
| Exp. 33 | | | | | | 25 | 4 | ++ | ++ | + |

INDUSTRIAL APPLICABILITY

According to the electrophotographic photoconductor of the present invention, a plurality of polycarbonate resins is used as a binding resin and a biphenyl derivative having a given structure is used as a plasticizer component, where generation of cracks, crystallization of a photosensitive layer, and the like due to the sticking of finger oil occur infrequently, while a given abrasion resistance is retained.

Therefore, the electrophotographic photoconductor of the present invention is expected to contribute to provide various image-forming apparatuses, such as copying machines and printers, with improved properties of endurance, speed-up, high performance, and so on.

What is claimed is:

1. An electrophotographic photoconductor, comprising:

a conductive substrate on which a photosensitive layer containing at least a charge generating agent, a hole transfer agent and a binding resin is provided, wherein the binding resin is comprised of a plurality of polycarbonate resins which contain 10 to 80 parts by weight of polycarbonate resin represented by the general formula (7) below and 100 parts by weight of polycarbonate resin represented by the general formula (8) or (9) below, (7)

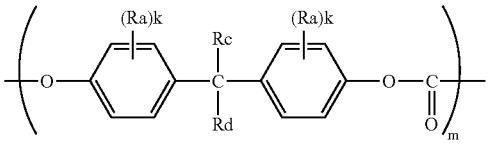

-continued

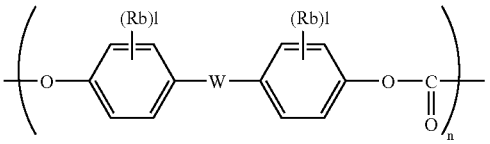

(In the general formula (7), Ra and Rb each independently represent a hydrogen atom, an alkyl group having 1 to 4 carbon atoms, or a substituted or unsubstituted aryl group having 6 to 12 carbon atoms, where the subscripts "k" and "l" each independently represent an integer of 0 to 4; Rc and Rd each represent an alkyl group having 1 to 2 carbon atoms, W represents a single bond or —O— or —CO— and the subscripts "m" and "n" each represent a mole ratio that satisfies a relational expression of 0.05<n/(n+m)<0.6)

(8)

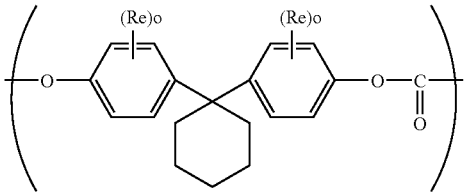

In the general formula (8), each of plural substituents Re represents a hydrogen atom, a substituted or unsubstituted alkyl group having 1 to 4 carbon atoms, or a substituted or unsubstituted aryl group having 6 to 30 carbon atoms, and the subscript "o" represents an integer of 0 to 4)

(9)

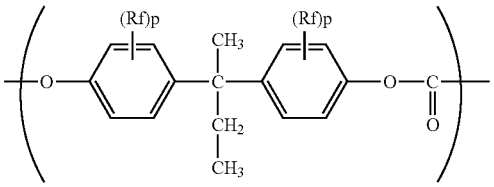

(In the general formula (9), each of plural substituents Rf represents a hydrogen atom, a substituted or unsubstituted alkyl group having 1 to 4 carbon atoms, or a substituted or unsubstituted aryl group having 6 to 30 carbon atoms, and the subscript "p" represents an integer of 0 to 4); and the photosensitive layer contains a biphenyl derivative as a plasticizer component, represented by the following general formula (1).

(1)

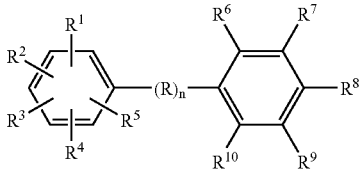

(In the general formula (1), wherein $R^1$ to $R^{10}$ each independently represent a hydrogen atom, a halogen atom, a substituted or unsubstituted alkyl group having 1 to 12, a substituted or unsubstituted alkoxyl group having 1 to 12, a substituted or unsubstituted aryl group having 6 to 30, a substituted or unsubstituted aralkyl group having 6 to 30, a substituted or unsubstituted cycloalkyl group having 3 to 12, a hydroxyl group, a cyano group, a nitro group, an amino group, and "R" represents a substituted or unsubstituted alkylene group having 1 to 12 or an organic functional group containing a nitrogen atom, and the number of repetitions "n" is an integer of 0 to 3).

2. The electrophotographic photoconductor according to claim 1, wherein, when the photosensitive layer is of a monolayer-type, the amount of the plasticizer component added is in the range of 0.1 to 15 parts by weight with respect to 100 parts by weight of the binding resin.

3. The electrophotographic photoconductor according to claim 1, wherein, when the photosensitive layer is of a multilayer-type, the amount of the plasticizer component added is in the range of 1 to 30 parts by weight with respect to 100 parts by weight of the binding resin.

4. The electrophotographic photoconductor according to claim 1, wherein the plasticizer component is a compound represented by one of the following formulae (2) to (6) or a derivative thereof (2)

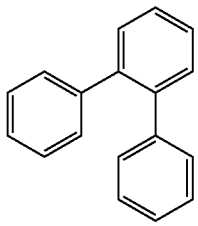

(BP-1)

(3)

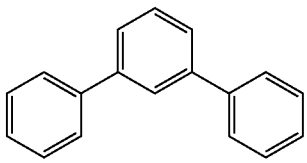

(BP-2)

(4)

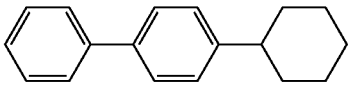

(BP-3)

-continued (5)

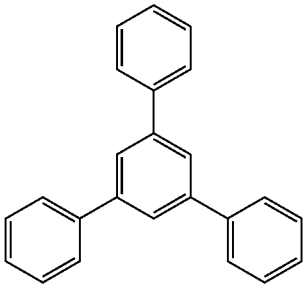

(BP-4)

(6)

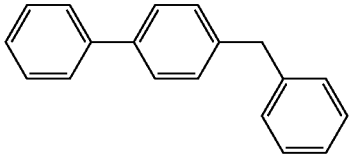

(BP-5)

5. The electrophotographic photoconductor according to claim 1, wherein the charge generating agent is a titanyl phthalocyanine crystal having the maximum peak at a Bragg angle of $2\theta \pm 0.2° = 27.2°$ in the CuKα characteristic X-ray diffraction spectrum and having one peak generated at a temperature within the range of 270 to 400° C. in addition to another peak due to vaporization of absorbed water in a differential scanning calorimeter.

6. The electrophotographic photoconductor according to claim 1, wherein the photosensitive layer has a 95% response time of 20 msec or less.

7. The electrophotographic photoconductor according to claim 1, wherein the photosensitive layer has a glass transition point of 65° C. or more.

8. The electrophotographic photoconductor according to claim 1, wherein the hole transfer agent is a bisstilbene compound or a bisbutadiene compound.

9. The electrophotographic photoconductor according to claim 8, wherein the bisstilbene compound or the bisbutadiene compound has a symmetrical structure.

* * * * *